US009163426B1

(12) United States Patent
Seneker et al.

(10) Patent No.: US 9,163,426 B1
(45) Date of Patent: Oct. 20, 2015

(54) COLLAPSIBLE SHELTER

(71) Applicant: Tilden LLC, Bloomfield Hills, MI (US)

(72) Inventors: Stephen A. Seneker, Bloomfield Hills, MI (US); Robert A. Bluthardt, Bloomfield Hills, MI (US)

(73) Assignee: Tilden KKC, Bloomfield Hills, MI (US)

( * ) Notice: Subject to any disclaimer, the term of this patent is extended or adjusted under 35 U.S.C. 154(b) by 0 days.

(21) Appl. No.: 14/020,236

(22) Filed: Sep. 6, 2013

(51) Int. Cl.
*E04H 15/06* (2006.01)
*E04H 15/48* (2006.01)

(52) U.S. Cl.
CPC ..... *E04H 15/48* (2013.01); *E04H 15/06* (2013.01)

(58) Field of Classification Search
CPC ..... E04H 15/06
USPC ..... 135/88.05, 88.08, 88.13; 296/161
See application file for complete search history.

(56) References Cited

U.S. PATENT DOCUMENTS

| | | | | |
|---|---|---|---|---|
| 3,115,362 | A * | 12/1963 | Spurrier | 135/88.14 |
| 3,186,420 | A * | 6/1965 | Magee | 135/88.07 |
| 3,929,147 | A * | 12/1975 | Roscoe | 135/140 |
| 6,179,368 | B1 * | 1/2001 | Karlsson | 296/161 |
| 7,568,491 | B2 * | 8/2009 | Banfill et al. | 135/88.08 |
| 7,819,128 | B2 * | 10/2010 | Clark et al. | 135/88.08 |
| 7,931,040 | B2 * | 4/2011 | Holacka et al. | 135/154 |
| 8,123,190 | B2 * | 2/2012 | Kost | 248/514 |
| 8,485,207 | B1 * | 7/2013 | Boyington | 135/88.08 |
| 2006/0254635 | A1 * | 11/2006 | Matheus et al. | 135/88.05 |
| 2011/0108076 | A1 * | 5/2011 | Connot | 135/88.05 |

* cited by examiner

*Primary Examiner* — Noah Chandler Hawk
(74) *Attorney, Agent, or Firm* — Honigman Miller Schwartz and Cohn LLP

(57) ABSTRACT

A collapsible shelter is disclosed. The collapsible shelter includes a canopy support subassembly, a canopy subassembly and a canopy cover. The canopy subassembly is removably and pivotally connected to the canopy support subassembly. The canopy cover is removably-disposed over the canopy subassembly. A method is also disclosed.

31 Claims, 20 Drawing Sheets

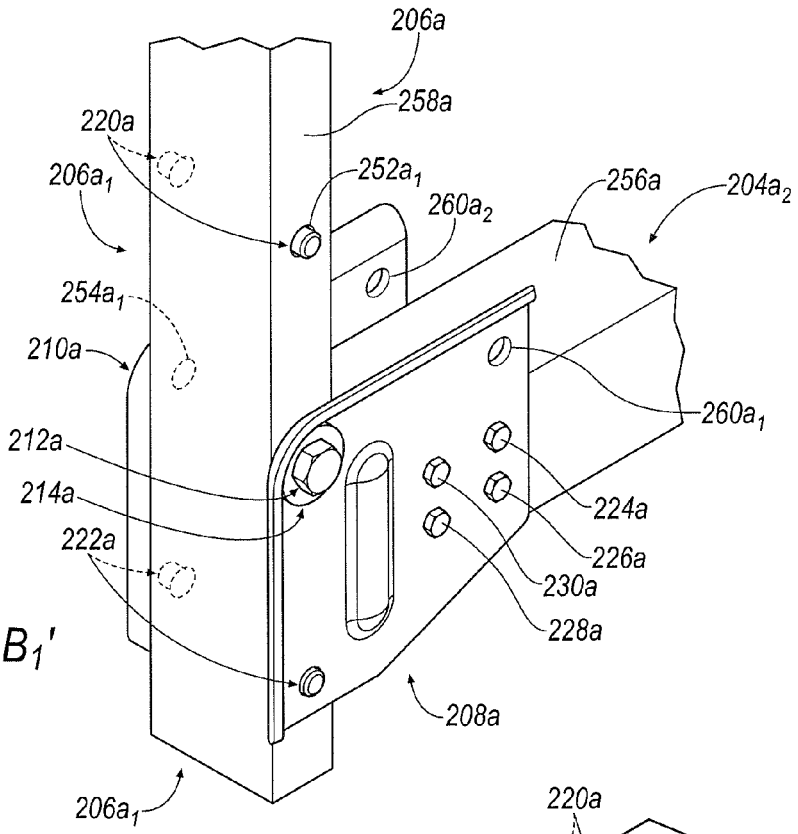
FIG. 3B1'
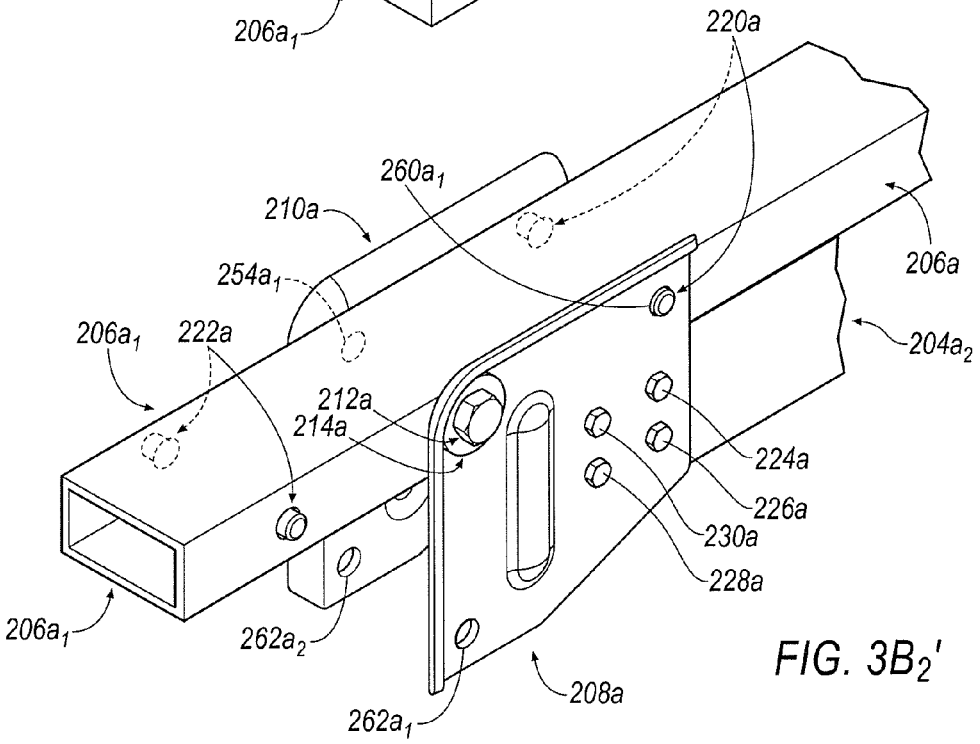
FIG. 3B2'

COLLAPSIBLE SHELTER

FIELD OF THE INVENTION

The disclosure relates to a collapsible shelter and a methodology for utilizing the same.

DESCRIPTION OF THE RELATED ART

Shelters are known in the art. Improvements to shelters are continuously being sought in order to advance the art.

BRIEF DESCRIPTION OF THE DRAWINGS

The disclosure will now be described, by way of example, with reference to the accompanying drawings, in which:

FIG. 3$B_1$' is an assembled view of the portion of the canopy support subassembly of FIG. 3A' arranged in a first orientation.

FIG. 3$B_2$' is an assembled view of the portion of the canopy support subassembly of FIG. 3A' arranged in a second orientation.

SUMMARY

Figure 1A:
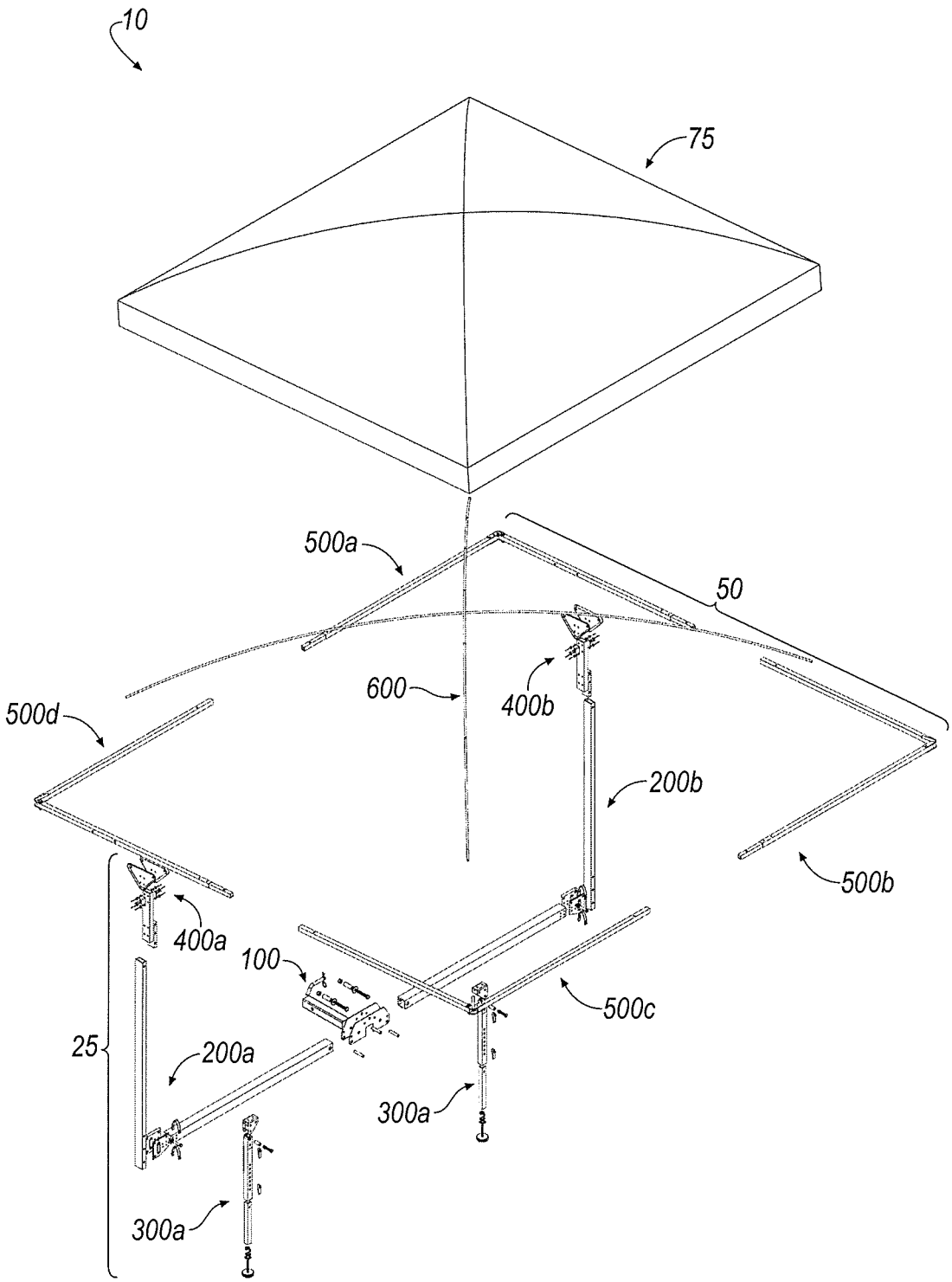
FIG. 1A is an exploded view of a collapsible shelter according to an embodiment.

One aspect of the disclosure provides a collapsible shelter. The collapsible shelter includes a canopy support subassembly, a canopy subassembly and a canopy cover. The canopy subassembly is removably and pivotally connected to the canopy support subassembly. The canopy cover is removably-disposed over the canopy subassembly.

In some examples, the canopy support subassembly includes a mounting subassembly, a first base subassembly, a second base subassembly, a first leg subassembly, a second leg subassembly, a first canopy pivot bracket subassembly and a second canopy pivot bracket subassembly. The first base subassembly is pivotally-connected to a first end of the mounting subassembly. The second base subassembly is pivotally-connected to a second end of the mounting subassembly. The first leg subassembly is pivotally-connected to the first base subassembly. The second leg subassembly is pivotally-connected to the second base subassembly. The first canopy pivot bracket subassembly is removably-connected to the first base subassembly. The second canopy pivot bracket subassembly is removably-connected to the second base subassembly.

In some implementations, each of the first and second base subassemblies include a bumper tube and a canopy-supporting tube.

In some instances, a proximal end of the bumper tube of each of the first and second base subassemblies is pivotally-connected to the mounting subassembly. A proximal end of the canopy-supporting tube is pivotally-connected to a distal end of the bumper tube.

In some examples, the first canopy pivot bracket subassembly is removably-joined to a distal end of the canopy-supporting tube. The second canopy pivot bracket subassembly is removably-joined to a distal end of the canopy-supporting tube.

In some implementations, the first leg subassembly is pivotally-connected to the bumper tube of the first base subassembly. The second leg subassembly is pivotally-connected to the bumper tube of the second base subassembly.

In some instances, the canopy subassembly includes a plurality of removably-connected canopy bracket subassemblies that form a canopy material support frame. A first side of the canopy material support frame is removably and pivotally connected to the first canopy pivot bracket subassembly. A second side of the canopy material support frame is removably and pivotally connected to the second canopy pivot bracket subassembly.

In some examples, the canopy subassembly includes a plurality of canopy cover support rods that are removably-connected to the canopy material support frame.

In some implementations, the canopy subassembly includes a canopy cover that is removably-arranged over and connected to the canopy material support frame and the canopy cover support rods.

In some instances, the canopy support subassembly includes a mounting subassembly for mounting the collapsible shelter to a mounting structure.

In some examples, the mounting structure is a hitch of a vehicle for permitting the collapsible shelter to be removably-mounted to the vehicle. The canopy support subassembly is removably-connected to the hitch of the vehicle in one of a stowed orientation and a deployed orientation.

In some implementations, each of a first and second base subassembly of the canopy support subassembly includes: a bumper tube and a canopy-supporting tube. An arrangement of the canopy support subassembly in a deployed orientation results in the bumper tube of each of the first and second base subassemblies being arranged in parallel to and next to but slightly spaced apart from a bumper of the vehicle while the canopy-supporting tube of each of the first and second base subassemblies is arranged substantially perpendicular with respect to the bumper tube.

In some instances, canopy subassembly is removably and pivotally connected to the canopy support subassembly in a cantilevered manner relative the canopy support subassembly such that a distal end of the canopy subassembly is not supported by any structural member, thereby defining an interference-free area directly underneath three of four sides of the canopy subassembly that defines a footprint of the canopy subassembly.

Another aspect of the disclosure provides a method including the steps of providing a collapsible shelter including a canopy support subassembly, a canopy subassembly, and a canopy cover; removably-and-pivotally-connecting the canopy subassembly to the canopy support subassembly; and removably-disposing the canopy cover over the canopy subassembly.

In some examples, prior to the removably-and-pivotally-connecting and the removably-disposing steps, the method further includes the step of: arranging the canopy support subassembly in a deployed orientation from a stowed orientation. The arranging step includes: pivoting a proximal end of a bumper tube of each of a first and second base subassemblies of the canopy support subassembly relative a mounting subassembly, then pivoting a proximal end of a canopy-supporting tube of the first and second base subassemblies of the canopy support subassembly relative a distal end of the bumper tube.

In some implementations, the arranging step further includes: removably-joining first and second canopy pivot bracket subassemblies of the canopy support subassembly to a distal end of the canopy-supporting tube of the first and second base subassemblies of the canopy support subassembly.

In some instances, the arranging step further includes: pivoting first and second leg subassemblies of each of the first and second base subassemblies of the canopy support subassembly relative to the bumper tube of each of the first and second base subassemblies of the canopy support subassembly.

In some examples, the canopy subassembly includes a plurality of canopy bracket subassemblies. After the arranging step and before the removably-and-pivotally-connecting step, the method further includes the step of: forming a canopy material support frame by removably-connecting a plurality of canopy bracket subassemblies. The removably-and-pivotally-connecting step includes: pivotally-connecting respective first and second sides of the canopy material support frame to the first and second canopy pivot bracket subassemblies.

In some implementations, the canopy subassembly includes a plurality of canopy cover support rods. After the removably-and-pivotally-connecting step and before the removably-disposing step, the method further includes the step of: removably-connecting a plurality of canopy cover support rods to the canopy material support frame.

DETAILED DESCRIPTION OF THE INVENTION

The Figures illustrate an exemplary embodiment of a collapsible shelter in accordance with an embodiment of the invention. Based on the foregoing, it is to be generally understood that the nomenclature used herein is simply for convenience and the terms used to describe the invention should be given the broadest meaning by one of ordinary skill in the art.

Figure 1B:
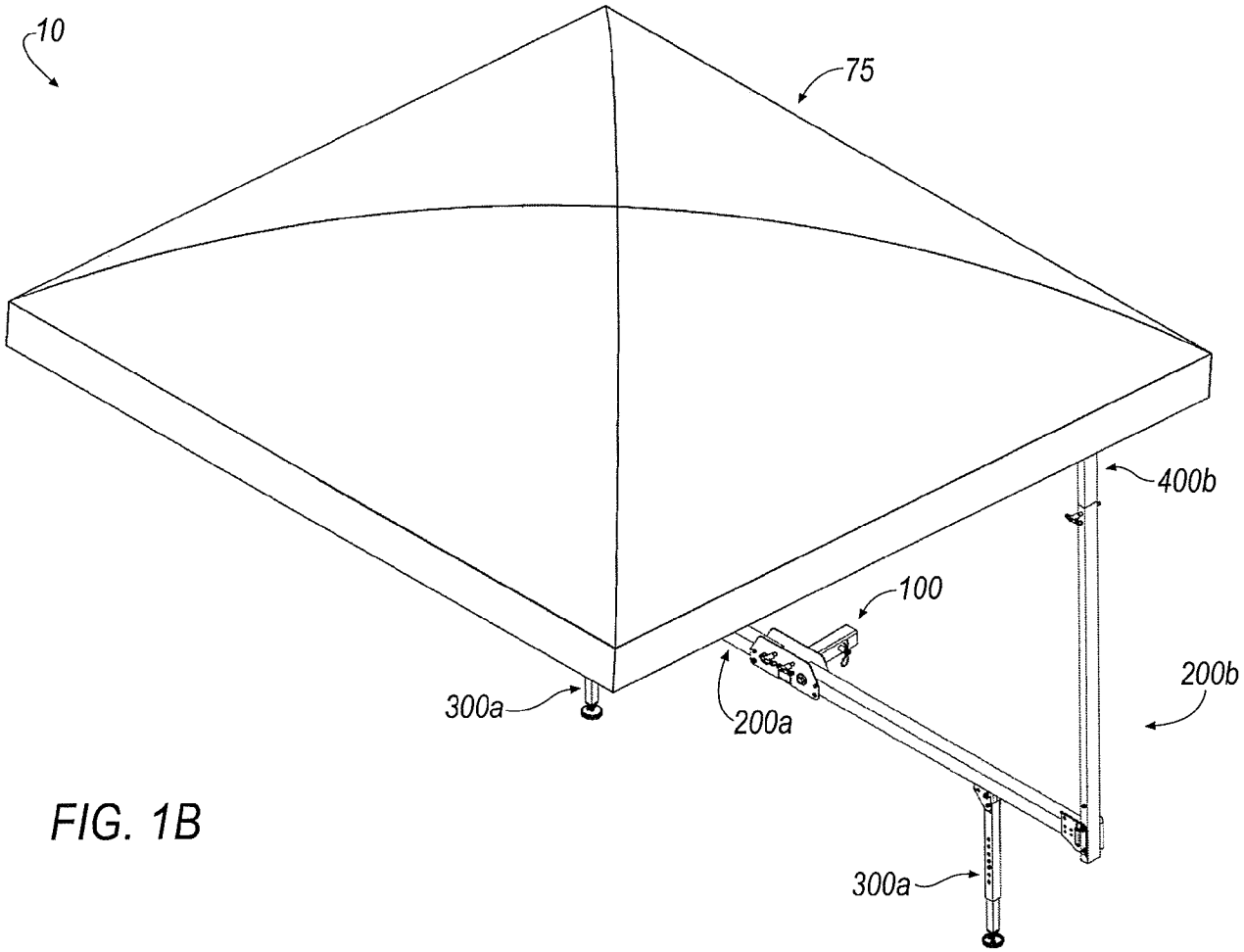
FIG. 1B is an assembled view of the collapsible shelter of FIG. 1A.

A collapsible shelter is shown generally at 10 at FIGS. 1A-1B according to an embodiment of the invention. The collapsible shelter 10 may be mounted to a vehicle, V (see, e.g., FIGS. 7A-7G). A location for mounting the collapsible shelter 10 to the vehicle, V, may be a trailer hitch, H, that is proximate a rear bumper, B, of the vehicle, V. The vehicle, V, may include, but is not limited to: a car, truck, sport utility vehicle (SUV), or the like. Although a vehicle, V, may serve as a mounting structure for the collapsible shelter 10, the collapsible shelter 10 may be mounted to other structural components including, but not limited to: a tree, a counter-weight or the like.

Figure 7A:
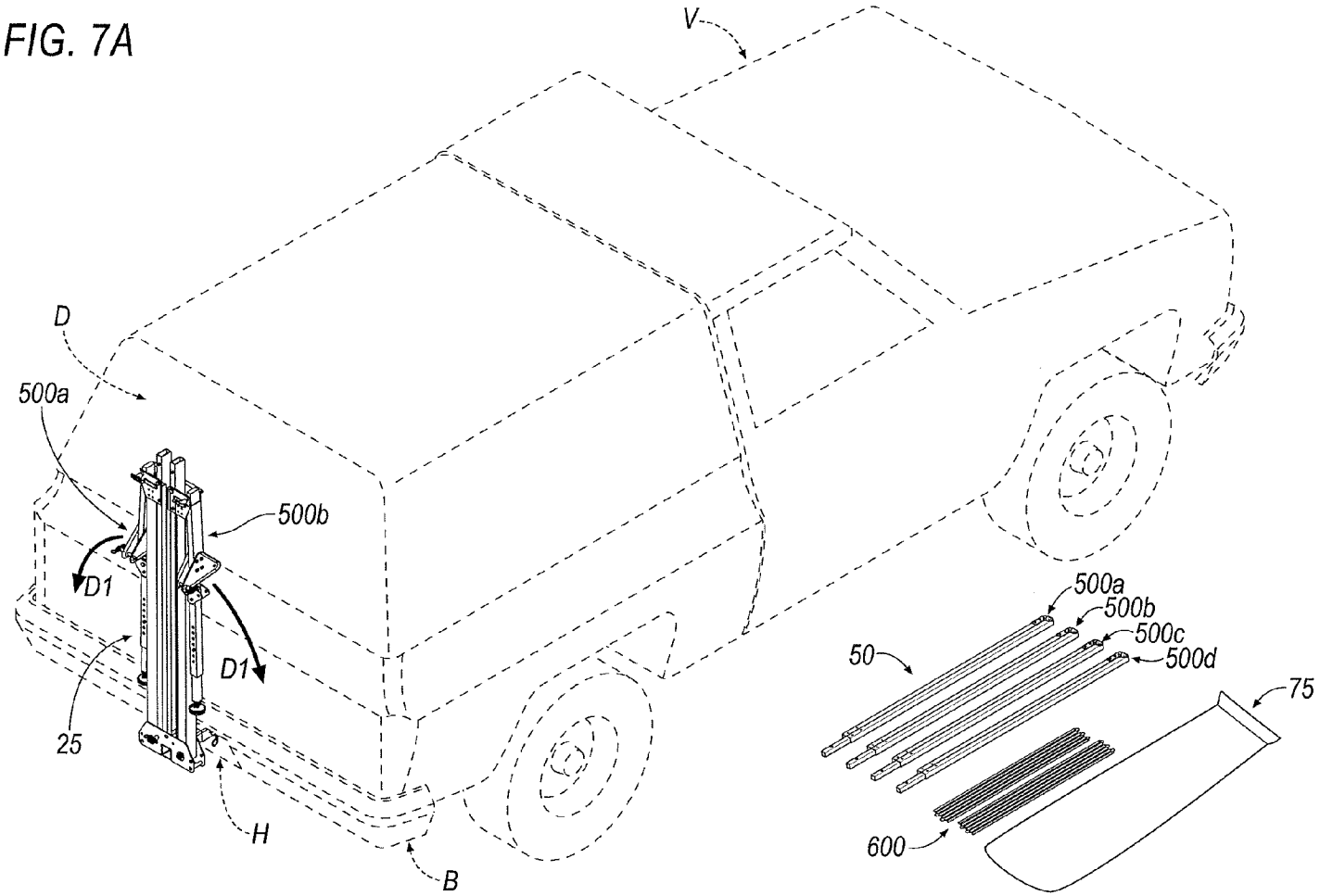
FIG. 7A is a perspective view of a vehicle and the collapsible shelter of FIGS. 1A-1B in a stowed orientation.
Figure 7B:
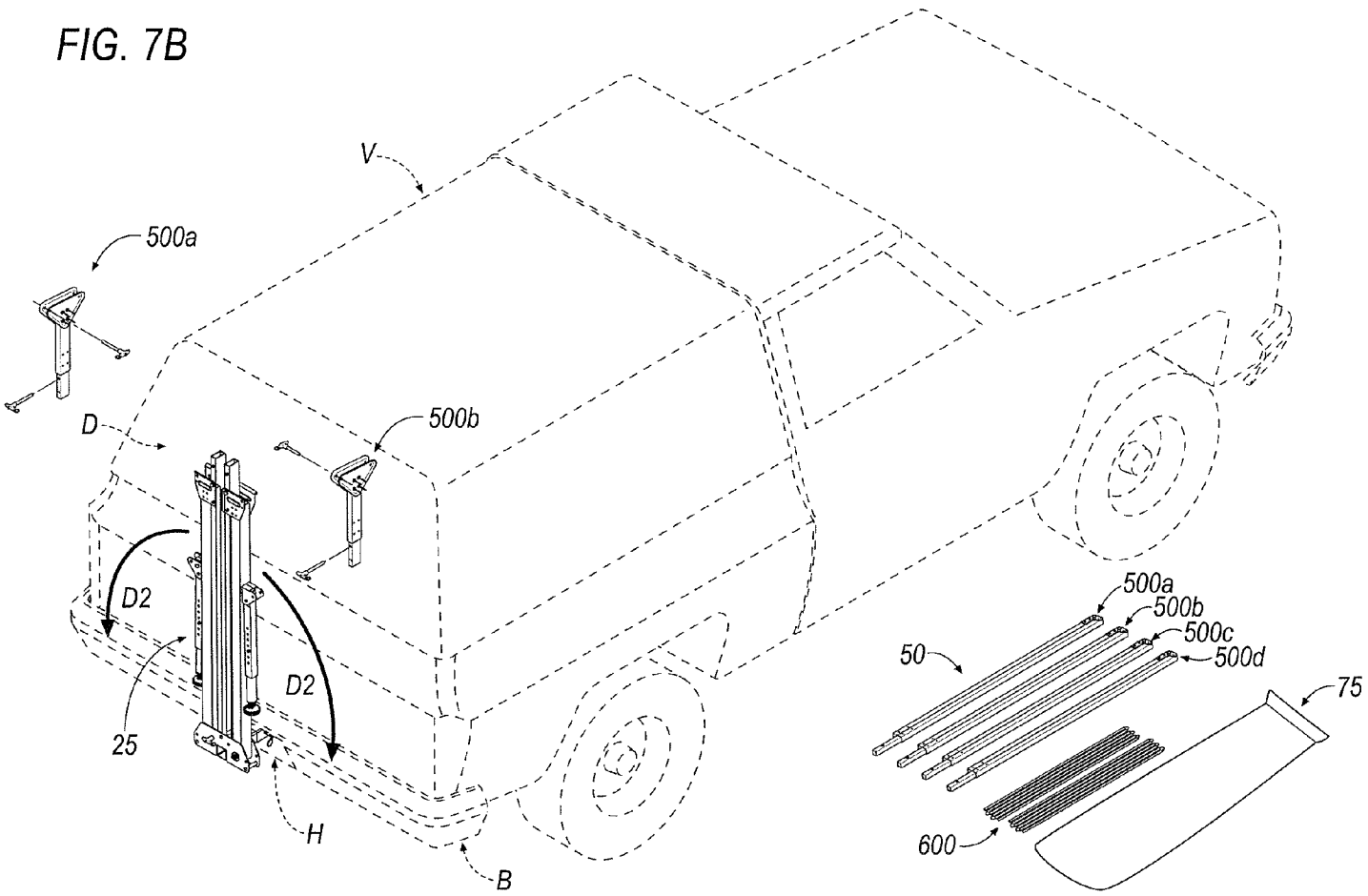
FIG. 7B-7F are perspective views of the vehicle of FIG. 7A and the collapsible shelter of FIGS. 1A-1B in a partially deployed orientation.
Figure 7C:
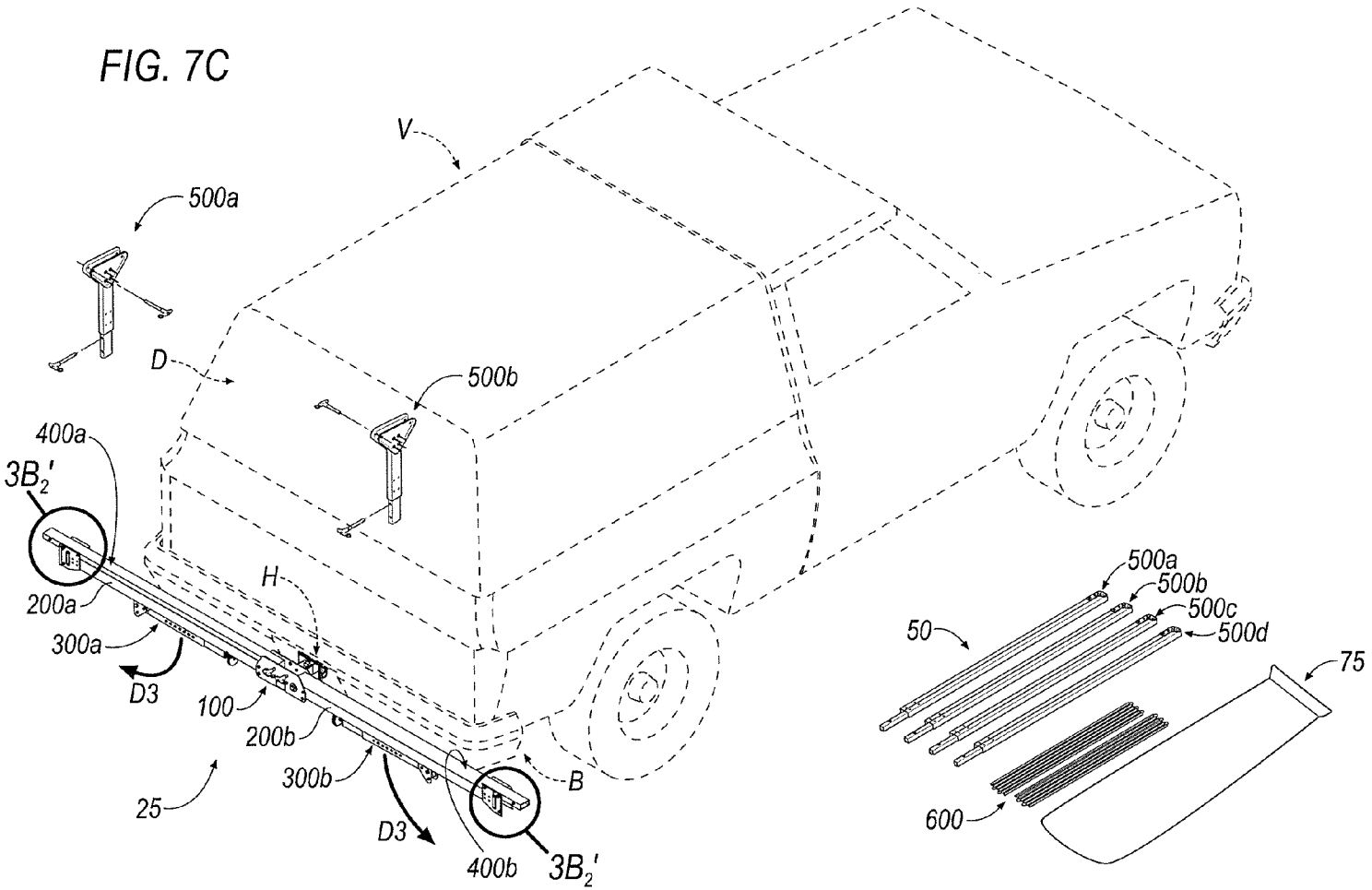
Figure 7D:
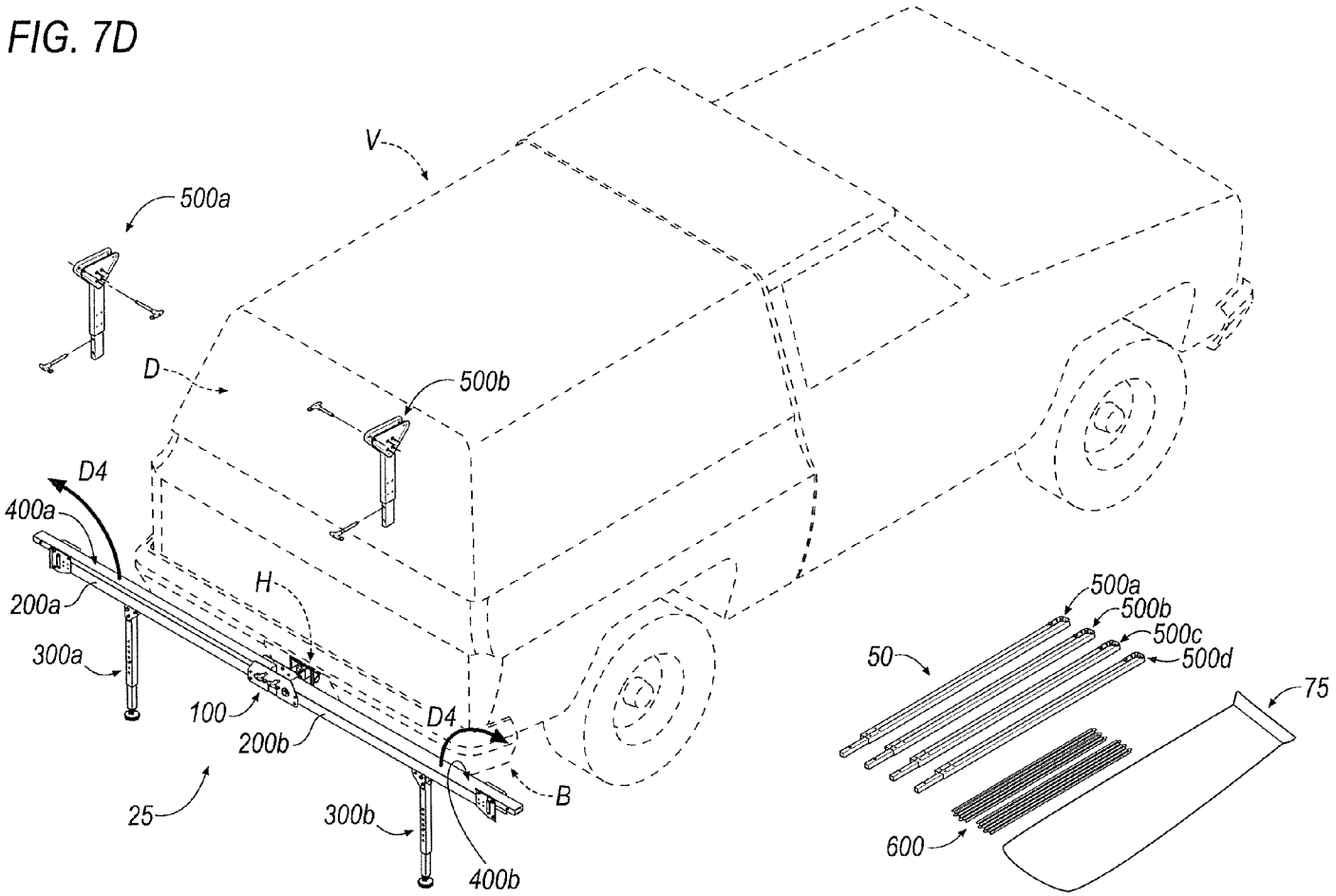
Figure 7E:
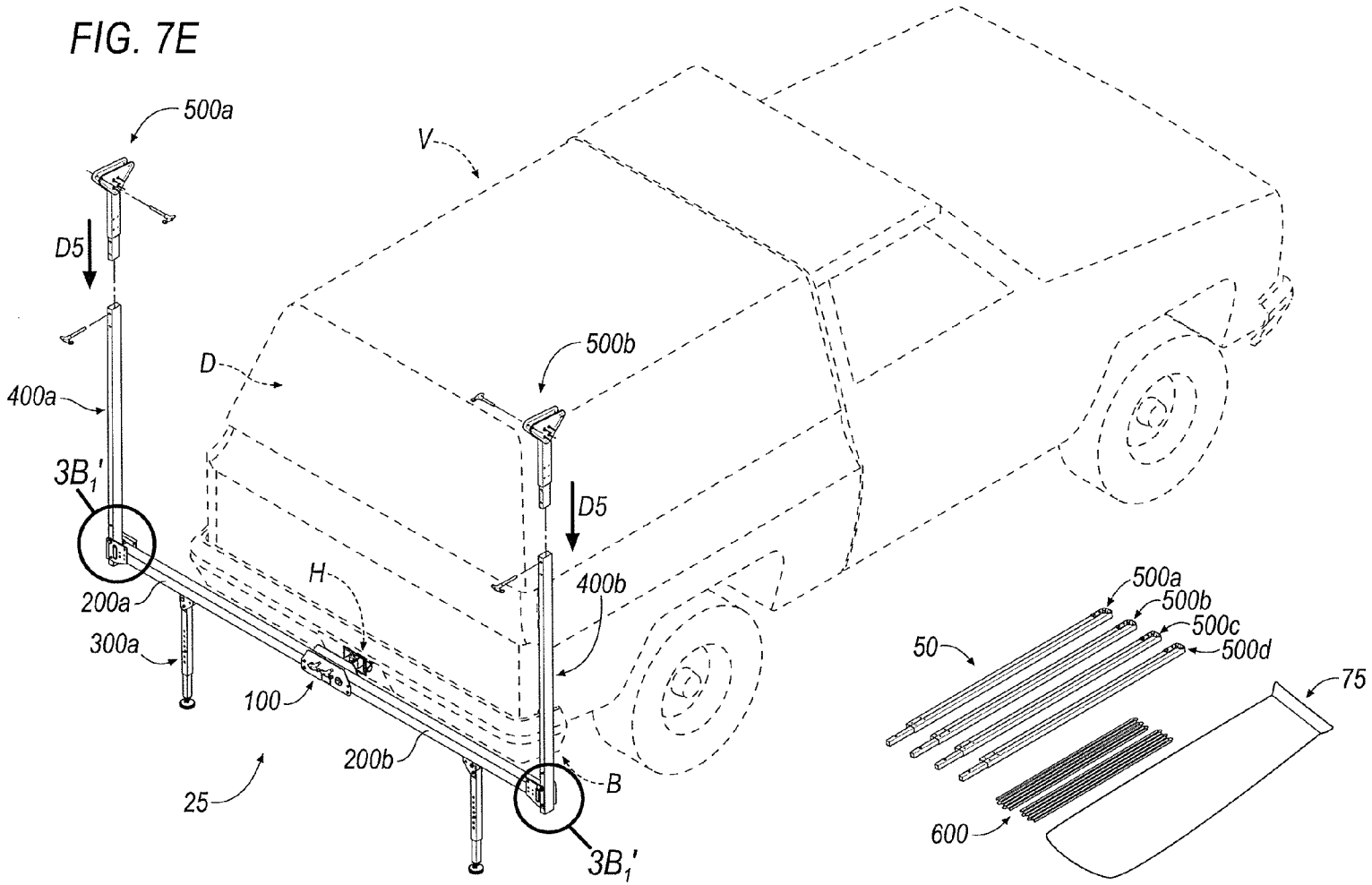

As seen in FIG. 7A, the collapsible shelter 10 may be arranged in a stowed orientation relative to the vehicle, V. As seen in FIG. 7G, the collapsible shelter may be arranged in a deployed orientation relative to the vehicle, V.

When arranged in the stowed orientation (as seen in FIG. 7A) and attached to mounting structure such as the vehicle, V, a portion (see, e.g., reference numeral 25 in FIG. 1A) of the collapsible shelter 10 may be removably-mounted to the mounting structure. Further, when arranged in the stowed orientation, another portion (see, e.g., reference numerals 50, 75 in FIG. 1A) of the collapsible shelter 10 may be stored within or exterior of the vehicle, V. If the portion 50, 75 of the collapsible shelter 10 is stored within the vehicle, V, the location within the vehicle, V, may include, for example: the passenger compartment, the trunk, the boot, the bed, or the like. If the portion 50, 75 of the collapsible shelter 10 is stored upon the vehicle, V, the location exterior of the vehicle, V, may include, for example, a roof rack.

When arranged in the deployed orientation (as seen in FIG. 7G) and attached to mounting structure such as the vehicle, V, a main supporting portion (see, e.g., reference numeral 25 in FIG. 1A) of the collapsible shelter 10 is arranged substantially adjacent a rear end (see, e.g., reference letter, D) of the vehicle, V, such that an overhead portion (see, e.g., reference numerals 50, 75 in FIG. 1A) of the collapsible shelter 10 is arranged in a cantilevered manner relative the main supporting portion. Because the overhead portion is arranged in a cantilevered manner relative the main supporting portion, a distal end of the overhead portion is not supported by any structural member, thereby defining an interference-free area directly underneath three of four sides of the overhead portion that defines a footprint of the overhead portion. Because of the interference-free area provided directly underneath three of four sides of the overhead portion that defines the footprint of the overhead portion, objects, persons or other vehicles may pass underneath and traverse the footprint of the collapsible shelter 10 that is defined by three of the four sides of the overhead portion without upsetting the arrangement of or deployed orientation of the collapsible shelter 10.

Further, when arranged in the deployed orientation, attached to a vehicle, V, and arranged substantially adjacent a rear end, D, of the vehicle, V, as seen in FIG. 7G, the collapsible shelter 10 may not interfere with operation of or deny access to the rear end, D, of the vehicle, V, such that one or more persons may, for example, retrieve or deposit one or more items from/into the rear end, D, of the vehicle, V. In some implementations, the rear end, D, of the vehicle, V, may include a hatch-back door of an SUV. In another implementation, the rear end, D, of the vehicle, V, may include a hatch-back door of an SUV that also includes a pivotally-deployable hatch-back glass window/door. In other implementations, the rear end, D, of the vehicle, V, may include a tailgate of a truck. In yet another implementation, the read end, D, of the vehicle, V, may include a truck bed cap including a pivotally-deployable hatch-back glass window/door.

Referring to FIG. 1A, the collapsible shelter 10 may include a canopy support subassembly 25, a canopy subassembly 50 and a canopy cover 75. The canopy support subassembly 25 may be removably-mounted to the vehicle, V. The vehicle, V, may be operated (e.g., driven) while the canopy support subassembly 25 is maintained in a stowed orientation (as seen in, e.g., FIG. 7A). The canopy subassembly 50 and the canopy cover 75 may be stored within or upon an exterior portion of the vehicle, V, while the vehicle, V, is operated (e.g., driven) or maintained in a static (e.g., parked) orientation. When the vehicle, V, arrives at a destination (e.g., a parking lot of a stadium or campsite), the canopy support subassembly 25 may be manipulated from the stowed orientation (as seen in, e.g., FIG. 7A) to one or more of a partially deployed orientation (as seen in FIGS. 7B-7D) and a fully deployed orientation (as seen in, e.g., FIG. 7E). The components 500*a*-500*d* and 600 of the canopy subassembly 50 may then be removed from a stowed orientation within or upon the vehicle, V, and assembled at the destination for subsequent removable-attachment (as seen in, e.g., FIGS. 7F-7G and FIGS. 8A-8C) to the canopy support subassembly 25. Once the canopy subassembly 50 is removably-attached to the canopy support subassembly 25, the canopy cover 75 may be removed from a stowed orientation within or upon the vehicle, V, and disposed over and removably-attached to the canopy subassembly 50 (as seen in, e.g., FIGS. 7F-7G).

The canopy support subassembly 25 may include a plurality of subassemblies that are shown generally at 100, 200*a*, 200*b*, 300*a*, 300*b*, 400*a*, 400*b*, 500*a* and 500*b*. The canopy subassembly 50 may include a plurality of subassemblies that are shown generally at 500*a*, 500*b*, 500*a*, 500*b* and 600.

Figure 2:
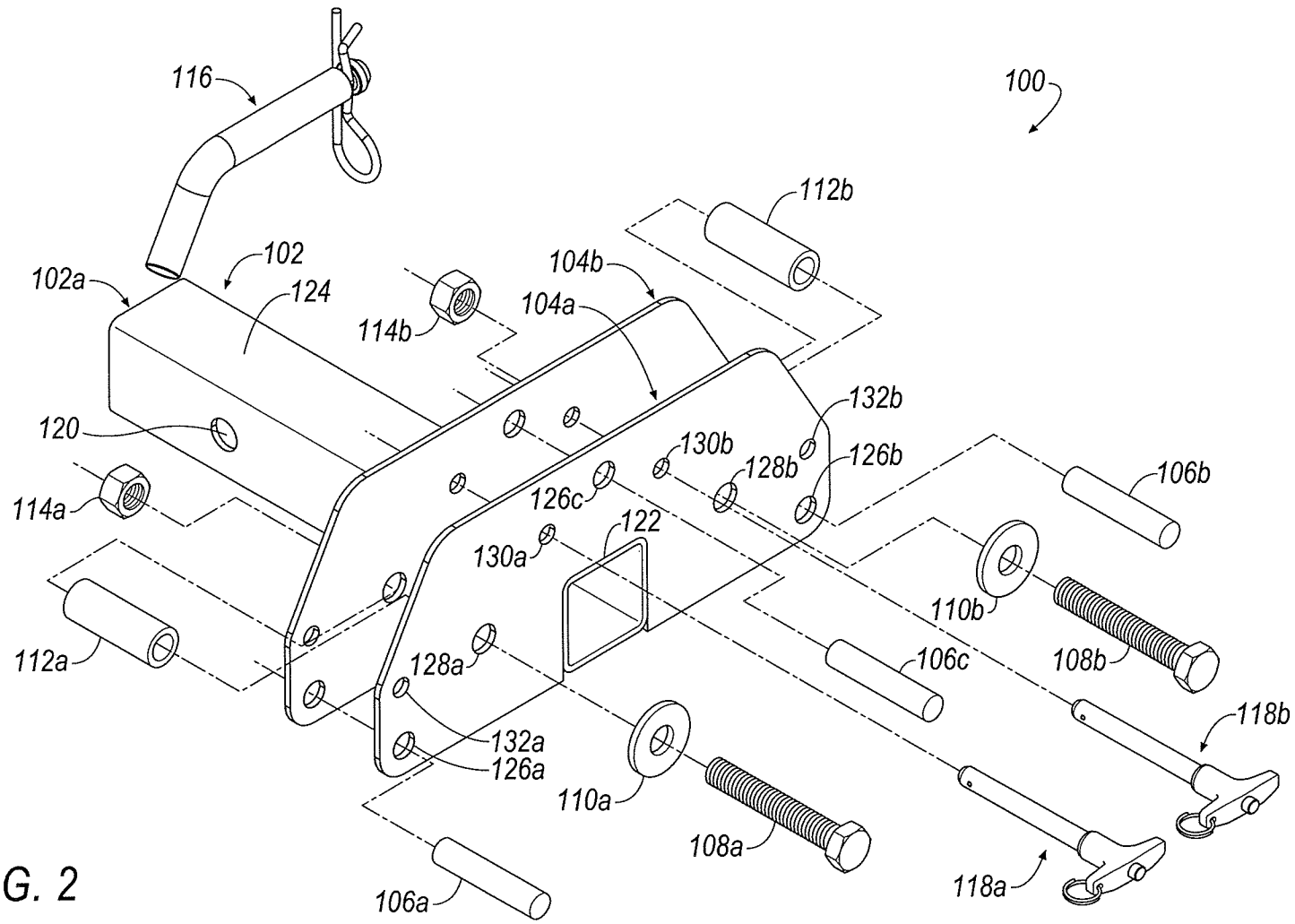
FIG. 2 is an exploded view of a portion of a canopy support subassembly of the collapsible shelter of FIGS. 1A-1B.

Referring to FIG. 2, a mounting subassembly of the canopy support subassembly 25 is shown generally at 100 according to an embodiment of the invention. The mounting subassembly 100 is directly attached to mounting structure, such as, for example, the vehicle, V, for removably-mounting the collapsible shelter 10 to the vehicle, V. In some implementations, the mounting subassembly 100 may be attached to the trailer hitch, H, that is proximate the rear bumper, B, of the vehicle, V.

The mounting subassembly 100 has a plurality of components 102-118. The plurality of components include: a trailer hitch interface tube 102, a pair of brackets defined by a first bracket 104*a* and a second bracket 104*b*, at least one (e.g., three) bracket spacer pins 106*a*, 106*b*, 106*c*, a pair of bolts defined by a first bolt 108*a* and a second bolt 108*b*, a pair of washers defined by a first washer 110*a* and a second washer 110*b*, a pair of bolt sleeves defined by a first bolt sleeve 112*a* and a second bolt sleeve 112*b*, a pair of nuts defined by a first nut 114*a* and a second nut 114*b*, a locking pin 116 and a pair of quick release locking pins defined by a first locking pin 118*a* and a second locking pin 118*b*.

The trailer hitch interface tube 102 includes a locking pin receiving passage 120. A proximal end 102*a* of the trailer hitch interface tube 102 may be inserted into the trailer hitch, H, such that the locking pin receiving passage 120 is aligned with a corresponding locking pin receiving passage (not shown) formed by the trailer hitch, H; once the locking pin receiving passages 120 are aligned, the locking pin 116 may be inserted there-through for selectively-joining the trailer hitch interface tube 102 to the trailer hitch, H.

Each bracket 104*a*, 104*b* of the pair of brackets may define a notched recess 122. The notched recess 122 may correspond to a portion of an outer surface 124 of the trailer hitch interface tube 102 in order to permit the trailer hitch interface tube 102 to nest within the notched recess 122 for connecting (by way of, for example, a welded connection) each bracket 104*a*, 104*b* of the pair of brackets to the trailer hitch interface tube 102.

Each bracket 104*a*, 104*b* of the pair of brackets may also define a plurality of passages 126*a*-132*b* that extend through a thickness of each bracket 104*a*, 104*b* of the pair of brackets. The plurality of passages 126*a*-132*b* may be further characterized into groups (see, e.g., a first group of passages 126*a*-126*c*, a second group of passages 128*a*-128*b*, a third group of passages 130*a*-130*b* and a fourth group of passages 132*a*-132*b*) where each passage is formed to include a specific geometry (e.g., diameter) for providing a unique function in the operation of the collapsible shelter 10.

In an example, the first group of passages 126*a*-126*c* include a first diameter corresponding to a geometry (e.g., a diameter) of the outer surface of the bracket spacer pins 106*a*, 106*b*, 106*c* for permitting respective bracket spacer pins 106*a*, 106*b*, 106*c* to be arranged within respective the passages 126*a*, 126*b*, 126*c*. In an example, the second group of passages 128*a*-128*b* include a second diameter corresponding to a geometry (e.g., a diameter) of the outer surface of the first and second bolt sleeves 112*a*, 112*b* for permitting respective bolt sleeves 112*a*, 112*b* to be arranged within respective the passages 128*a*, 128*b*. In an example, the third group of passages 130*a*-130*b* include a third diameter corresponding to a geometry (e.g., a diameter) of the outer surface of the first and second locking pins 118*a*, 118*b* for permitting respective locking pins 118*a*, 118*b* to be arranged within respective the passages 130*a*, 130*b*. In an example, the fourth group of passages 132*a*-132*b* include a fourth diameter corresponding to a geometry (e.g., a diameter) of the outer surface of pairs of mounting subassembly spring-loaded ball pin locking projections 202*a*, 202*b* (see, e.g., FIG. 3) of the canopy support subassembly 25 for permitting respective pairs of mounting subassembly spring-loaded ball pin locking projections 202*a*, 202*b* to be arranged within respective the passages 132*a*, 132*b*.

Figure 3:
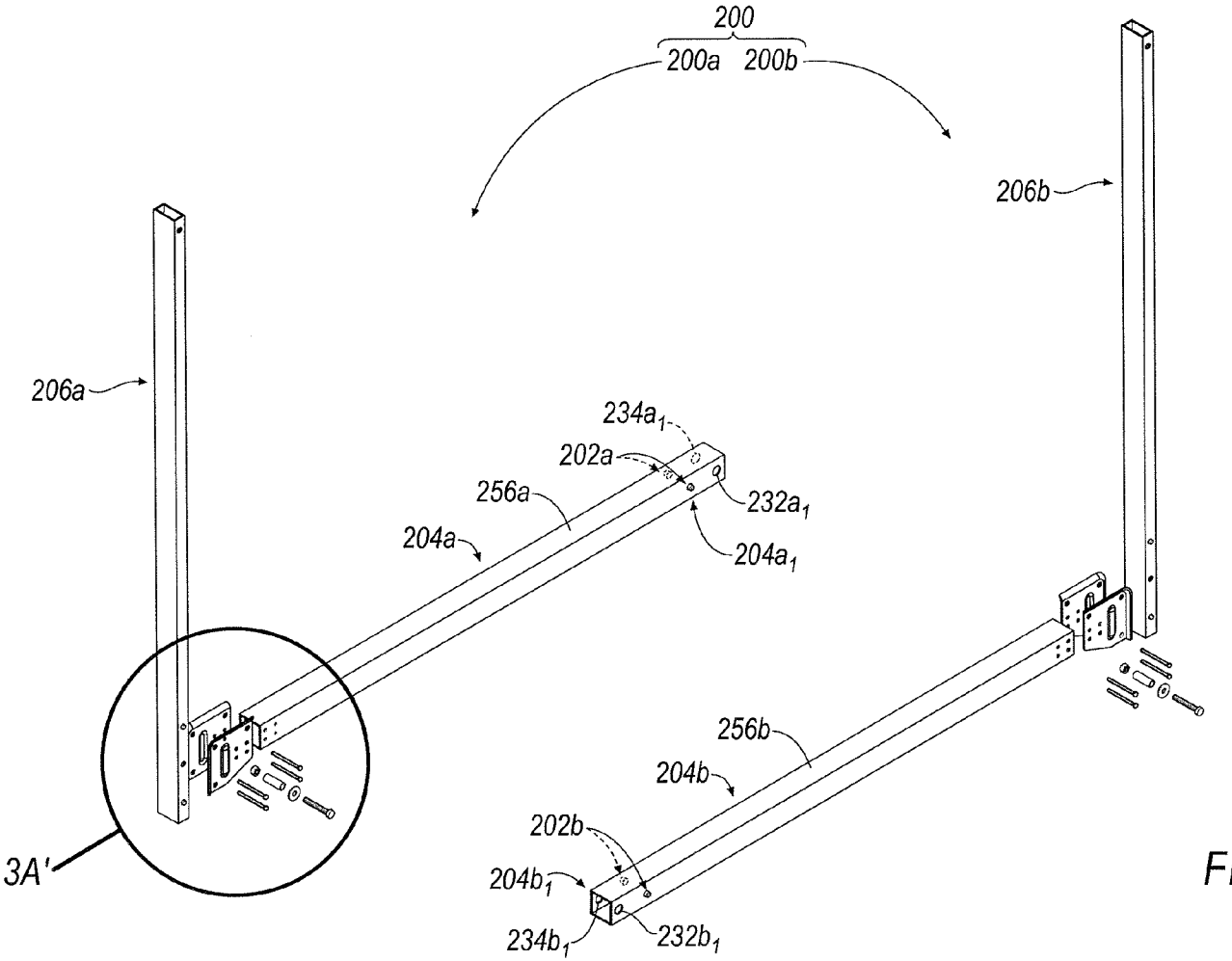
FIG. 3 is an exploded view of another portion of the canopy support subassembly of the collapsible shelter of FIGS. 1A-1B.

Referring to FIG. 3, a pair of base subassemblies (defined by a first base subassembly 200*a* and a second base subassembly 200*b*) of the canopy support subassembly 25 is shown generally at 200 according to an embodiment of the invention. As seen at FIG. 1B, each base subassembly 200*a*, 200*b* of the pair of base subassemblies 200 are pivotally-joined to the mounting subassembly 100 by the pair of bolts 108*a*, 108*b*, the pair of washers 110*a*, 110*b*, the pair of bolt sleeves 112*a*, 112*b* and the pair of nuts 114*a*, 114*b*. Because each base subassembly 200*a*, 200*b* of the pair of base subassemblies 200 are symmetrically-arranged with respect to the mounting subassembly 100 and includes the same components 202*a*-230*a*, 202*b*-230*b*, reference is only made to the first base subassembly 200*a* below (i.e., when pairing the description of the first base subassembly 200*a* to the second base subassembly 200*b*, the reader should swap the reference letter 'a' of reference numerals 202*a*-230*a* for the reference letter 'b').

Figure 3A:
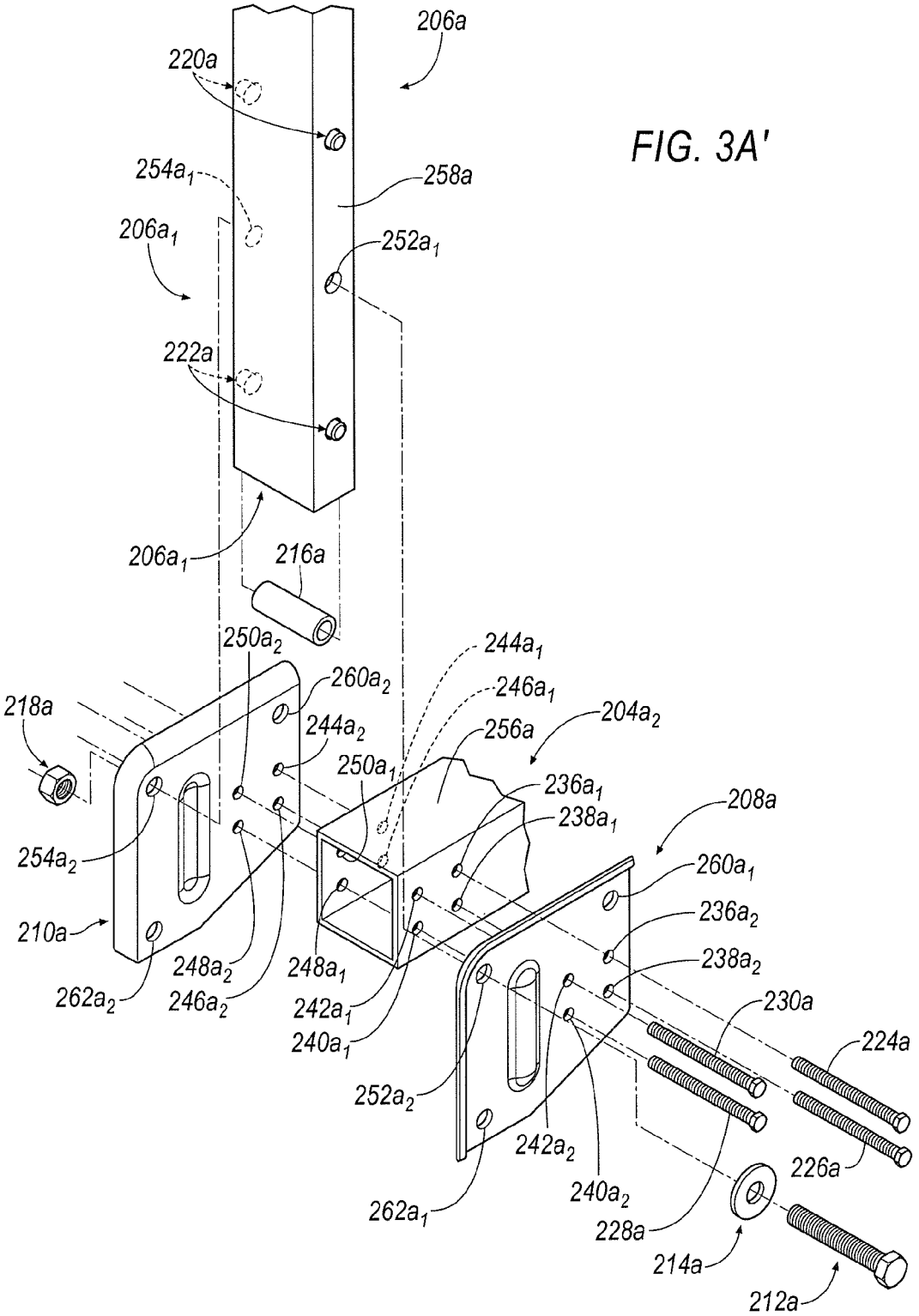
FIG. 3A' is an enlarged exploded view of FIG. 3 according to line 3'.

The first base subassembly 200*a* has a plurality of components 202*a*-230*a*. The plurality of components include: a pair of mounting assembly spring-loaded ball pin locking projections 202*a*, a bumper tube 204*a*, a canopy-supporting tube 206*a* and a plurality of tube-connecting components 208*a*-230*a* (see, e.g., FIG. 3A'). Referring to FIG. 3A', the plurality of tube-connecting components 208*a*-230*a* may include, for example, a pair of brackets defined by a first bracket 208*a* and a second bracket 210*a*, a bolt 212*a*, a washer 214*a*, a bolt sleeve 216*a*, a nut 218*a*, a pair of stowed position spring-loaded ball pin locking projections 220*a*, a pair of deployed position spring-loaded ball pin locking projections 222*a* and at least one (e.g., four) fasteners 224*a*, 226*a*, 228*a*, 230*a*, which may include, for example, bolts, mig welds, rivets or the like.

The bumper tube 204*a* includes a plurality of passages 232$a_1$-250$a_1$. The plurality of passages 232$a_1$-250$a_1$ may be further characterized into groups (see, e.g., a first group of passages 232$a_1$-234$a_2$ (see, e.g., FIG. 3) and a second group of passages 236$a_1$-250$a_1$ (see, e.g., FIG. 3A')). In an example, the first group of passages 232$a_1$-234$a_2$ include a first diameter corresponding to a geometry (e.g., a diameter) of the outer surface of the outer surface of the bolt sleeve 112*a* for permitting respective the bolt sleeve 112*a* to be arranged within the passages 232$a_1$-234$a_2$ for pivotally-connecting the first base subassembly 200*a* to the mounting subassembly 100. In an example, the second group of passages 236$a_1$-250$a_1$ include a second diameter corresponding to a geometry (e.g., a diameter) of the outer surface of the fasteners 224*a*, 226*a*, 228*a*, 230*a* for permitting respective fasteners 224*a*, 226*a*, 228*a*, 230*a* to be arranged within respective passages 236$a_1$-250$a_1$.

Referring to FIG. 3A', the canopy-supporting tube 206*a* includes a plurality of passages 252$a_1$-254$a_1$. The plurality of passages 252$a_1$-254$a_1$ may be further characterized into a first group of passages. In an example, the first group of passages 252$a_1$-254$a_1$ include a first diameter corresponding to a geometry (e.g., a diameter) of the outer surface of the outer surface of the bolt sleeve 216*a* for permitting the bolt sleeve 216*a* to be arranged within the passages 252$a_1$-254$a_1$.

Referring to FIG. 3, the pair of mounting assembly spring-loaded ball pin locking projections 202*a* are arranged upon opposing sides of an outer surface 256*a* of near a proximal end 204$a_1$ of the bumper tube 204*a*. Prior to manipulating the bumper tube 204*a* from being in a deployed orientation (see, e.g., FIG. 7C) that is aligned with and arranged parallel to the bumper, B, of the vehicle, V, each projection of the pair of mounting assembly spring-loaded ball pin locking projections 202*a* may be respectively registered within the passages 132*a* of the brackets 104*a*, 104*b* of the mounting subassembly 100 for selectively-maintaining the bumper tube 204 relative the mounting subassembly 100 in a stowed orientation.

Referring to FIG. 3A', a distal end 204$a_2$ of the bumper tube 204*a* includes the second group of passages 236$a_1$-250$a_1$. The first bracket 208*a* may include passages 236$a_2$-242$a_2$ that correspond to the passages 236$a_1$-242$a_1$ of the second group of passages 236$a_1$-250$a_1$, and, the second bracket 210*a* may include passages 244$a_2$-250$a_2$ that correspond to the passages 244$a_1$-250$a_1$ of the second group of passages 236$a_1$-250$a_1$. As seen in FIGS. 3$B_1$'-3$B_2$' the first and second brackets 208*a*, 210*a* are arranged upon opposing sides of the outer surface 256*a* of the distal end 204$a_2$ of the bumper tube 204*a*. The fasteners 224*a*, 226*a*, 228*a*, 230*a* are then passed through the second group of passages 236$a_1$-250$a_1$ of the bumper tube 204*a* and the passages 236$a_2$-250$a_2$ of the first and second brackets 208*a*, 210*a* for joining the first and second brackets 208*a*, 210*a* to the distal end 204$a_2$ of the bumper tube 204*a*.

With continued reference to FIG. 3A', a proximal end 206$a_1$ of the canopy-supporting tube 206*a* includes the plurality of passages 252$a_1$-254$a_1$. The first bracket 208*a* may include a passage 252$a_2$ that corresponds to the passage 252$a_1$ of canopy-supporting tube 206*a*, and, the second bracket 210*a* may include a passage 254$a_2$ that corresponds to the passage 254$a_1$ of the canopy-supporting tube 206*a*. As seen in FIGS. 3$B_1$'-3$B_2$' the first and second brackets 208*a*, 210*a* are arranged upon opposing sides of the outer surface 258*a* of the proximal end 206$a_1$ of the canopy-supporting tube 206*a*, and, the bolt 212*a*, the washer 214*a*, the bolt sleeve 216*a* and the nut 218*a* are utilized for pivotally-joining the proximal end 206*a* of the canopy-supporting tube 206*a* to the distal end 204$a_2$ of the bumper tube 204*a* by way of inserting the bolt 212 and bolt sleeve 216*a* through/within the passages 252$a_1$, 254$a_1$ formed by the first and second brackets 208*a*, 210*a* and the passages 252$a_2$, 254$a_2$ formed by the canopy-supporting tube 206 such that the canopy-supporting tube 206*a* may be pivotally-arranged relative the bumper tube 204*a* in deployed orientation (see, e.g., FIG. 3$B_1$') or a stowed orientation (see, e.g., FIG. 3$B_2$').

With further reference to FIG. 3A', the outer surface 258*a* of the proximal end 206*a* of the canopy-supporting tube 206*a* includes the pair of stowed position spring-loaded ball pin locking projections 220*a* and the pair of deployed position spring-loaded ball pin locking projections 222*a*. The first and second brackets 208*a* may include passages 260$a_1$, 260$a_2$ that correspond to the pair of stowed position spring-loaded ball pin locking projections 220*a* of canopy-supporting tube 206*a*, and, the first and second brackets 210*a* may include passages 262$a_1$, 262$a_2$ that correspond to the pair of deployed position spring-loaded ball pin locking projections 222*a*. As seen in FIG. 3$B_1$', when the canopy-supporting tube 206*a* is pivotally-arranged relative the bumper tube 204*a* in deployed orientation, the pair of deployed position spring-loaded ball pin locking projections 222*a* are registered within the passages 262$a_1$, 262$a_2$ for selectively-maintaining the canopy-supporting tube 206*a* relative the bumper tube 204*a* in the deployed orientation, and, as seen in FIG. 3$B_2$', when the canopy-supporting tube 206*a* is pivotally-arranged relative the bumper tube 204*a* in stowed orientation, the pair of stowed position spring-loaded ball pin locking projections 220*a* are registered within the passages 260$a_1$, 260$a_2$ for selectively-maintaining the canopy-supporting tube 206*a* relative the bumper tube 204*a* in the stowed orientation.

Figure 4:
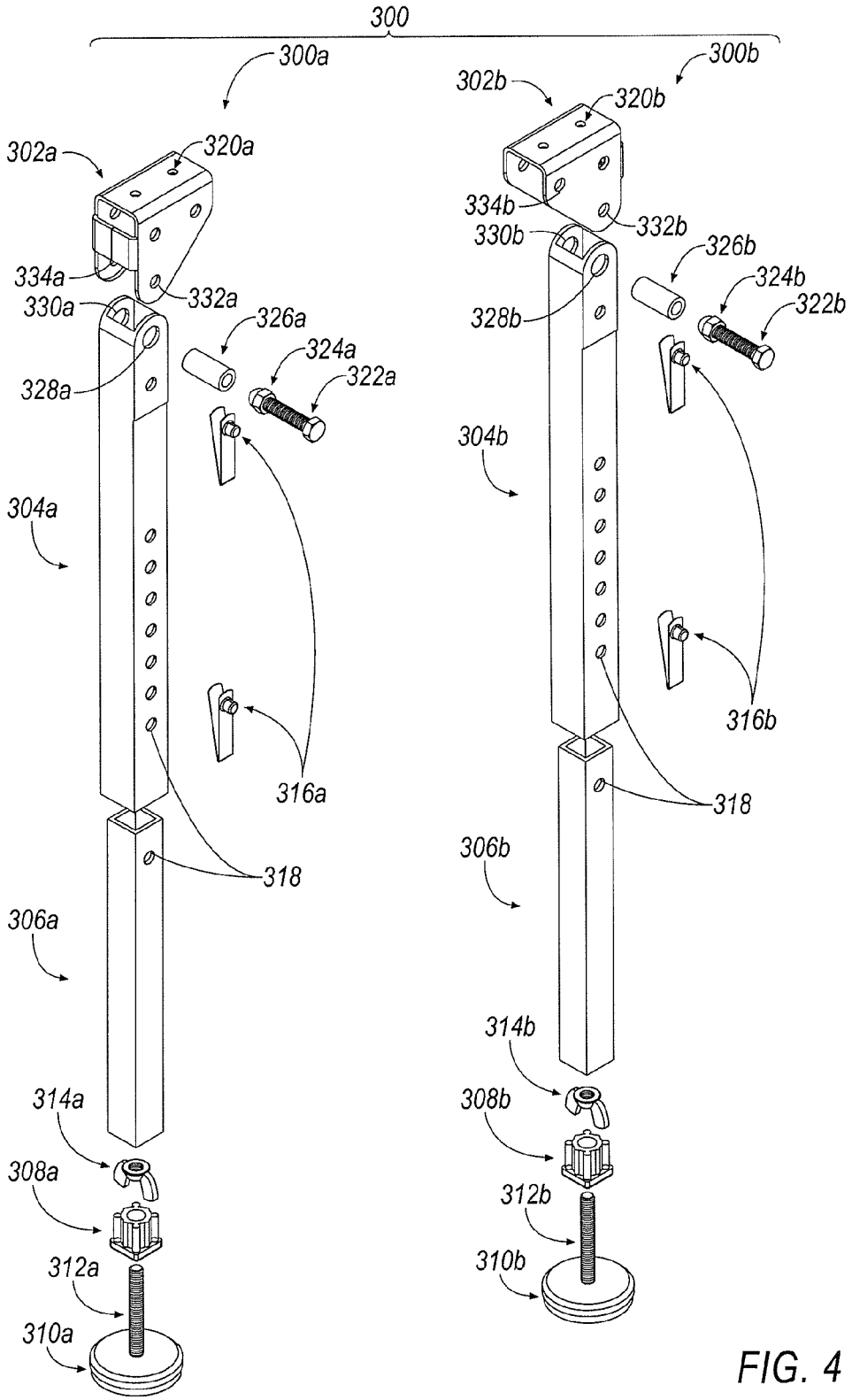
FIG. 4 is an exploded view of yet another portion of the canopy support subassembly of the collapsible shelter of FIGS. 1A-1B.

Referring to FIG. 4, a pair of leg subassemblies (defined by a first leg subassembly 300*a* and a second leg subassembly 300*b*) of the canopy support subassembly 25 is shown generally at 300 according to an embodiment of the invention. As seen at FIG. 1B, each leg subassembly 300*a*, 300*b* of the pair of base subassemblies 300 are respectively pivotally-connected to the lower side of the outer surface 256*a*, 256*b* of the bumper tubes 204*a*, 204*b*. Because each leg subassembly 300*a*, 300*b* of the pair of base subassemblies 300 are symmetrically-arranged with respect to the lower side of the outer surface 256*a*, 256*b* of the bumper tubes 204*a*, 204*b* and includes the same components 302*a*-334*a*, 302*b*-334*b*, reference is only made to the first leg subassembly 300*a* below (i.e., when pairing the description of the first leg subassembly 300*a* to the second leg subassembly 300*b*, the reader should swap the reference letter 'a' of reference numerals 302*a*-334*a* for the reference letter 'b').

The first leg subassembly 300*a* has a plurality of components 302*a*-334*a*. The plurality of components include: a folder bracket 302*a*, an outer leg 304*a*, an inner leg 306*a* and an end cap 308*a*. An adjustable foot 310*a* may be attached to the end cap 308*a* by a threaded stem portion 312*a* and wing-nut 314*a*. A pair of spring-loaded ball pin locking projections 316*a* may be disposed within and fixed to one of the outer leg 304*a* and the inner leg 306*a* for selectively-telescoping-adjusting the inner leg 306*a* relative the outer leg 304*a* by selectively arranging the pair of spring-loaded ball pin locking projections 316*a* within passages 318*a* formed by the outer leg 304*a* and the inner leg 306*a*. A fastener (e.g., a pop rivet) 320*a* may fix the folder bracket 302*a* to the lower side of the outer surface 256*a* of the bumper tube 204*a*. A bolt 322*a*, nut 324*a* and bolt sleeve 326*a* may be inserted through a pair of passages 328*a*, 330*a* formed by the outer leg 304*a* and a pair of passages 332*a*, 334*a* formed by the folder bracket 302*a* for pivotally-connecting the outer leg 304*a* to the folder bracket 302*a*.

Referring to FIG. 1A, a pair of canopy pivot bracket subassemblies (defined by a first canopy pivot bracket subassembly 400*a* and a second canopy pivot bracket subassembly 400*b*) of the canopy support subassembly 25 are shown according to an embodiment of the invention. As seen at FIG. 1B, each canopy pivot bracket subassembly 400*a*, 400*b* are respectively selectively-connected to a distal end 206$a_2$, 206$b_2$ of the canopy-supporting tube 206*a* by a canopy support subassembly quick release locking pin 402*a*, 402*b*. Because each canopy pivot bracket subassembly 400*a*, 400*b* are symmetrically-arranged with respect to the distal end 206$a_2$, 206$b_2$ of the canopy-supporting tube 206*a* and includes the same components 402*a*-424*a*, 402*b*-424*b*, reference is only made to the first canopy pivot bracket subassembly 400*a* below at FIGS. 5A-5B (i.e., when pairing the description of the first canopy pivot bracket subassembly 400*a* to the second canopy pivot bracket subassembly 400*b*, the reader should swap the reference letter 'a' of reference numerals 402*a*-424*a* for the reference letter 'b').

Figure 5A:
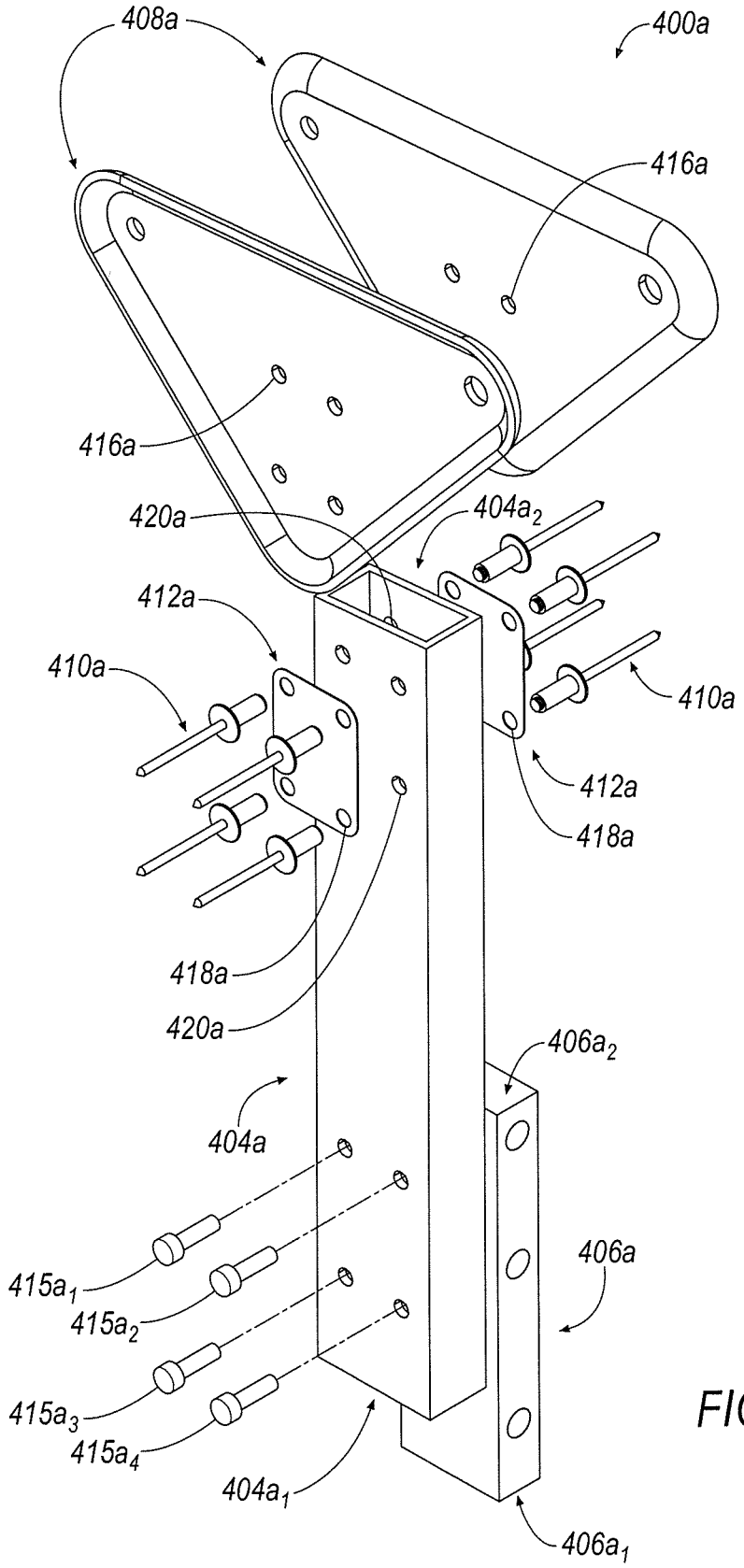
FIG. 5A is an exploded view of yet another portion of the canopy support subassembly of the collapsible shelter of FIGS. 1A-1B.
Figure 5B:
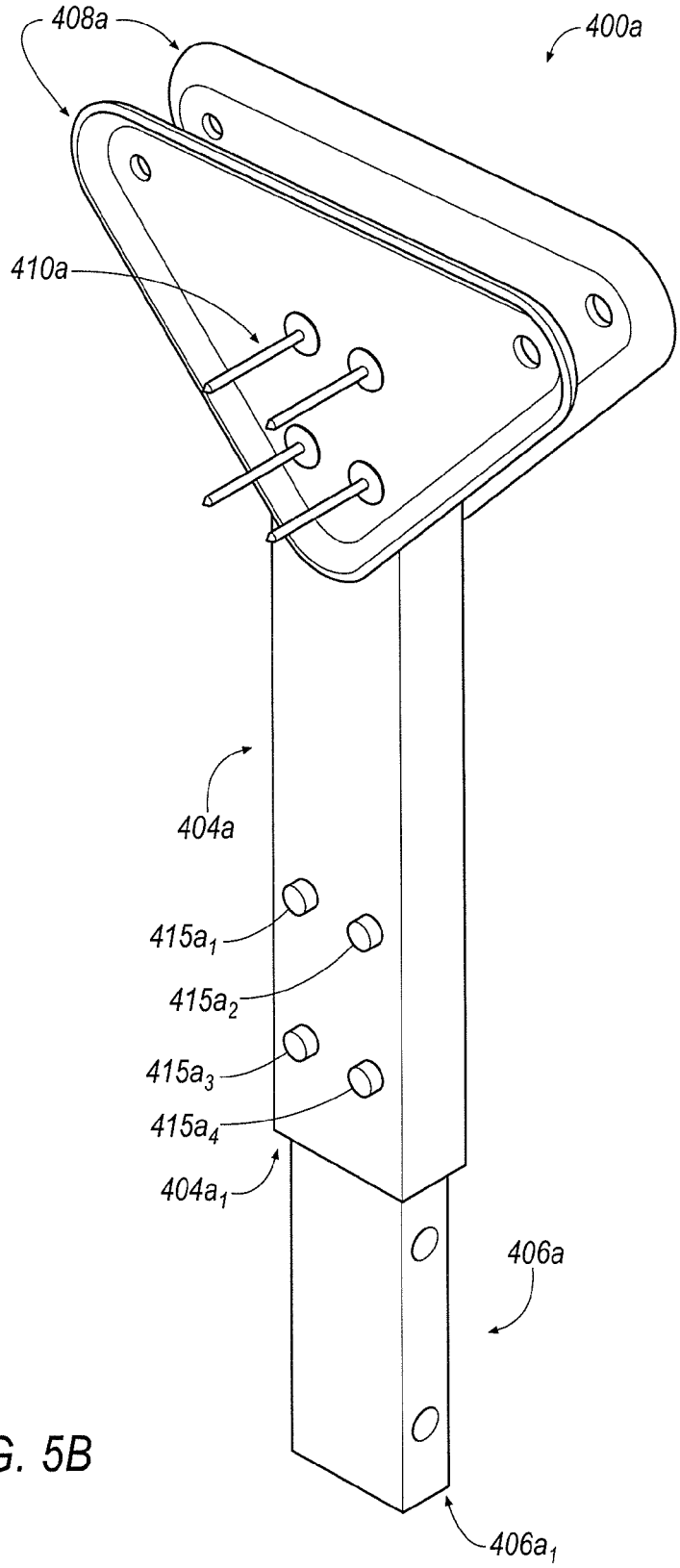
FIG. 5B is an exploded view of yet another portion of the canopy support subassembly of the collapsible shelter of FIGS. 1A-1B.

Referring to FIGS. 5A-5B, the canopy pivot bracket subassembly 400*a* has a plurality of components 402*a*-424*a*. The plurality of components include: the canopy support subassembly quick release locking pin 402*a* (see FIG. 1B), a bracket tube 404*a*, an insert tube 406*a*, a pair of canopy bracket guide plates 408*a*, a plurality of fasteners (e.g. pop rivets) 410*a*, a pair of side bracket plates 412*a* and a canopy subassembly quick release locking pin 414*a* (see FIGS. 8A-8C) and at least one (e.g., four) fasteners 415$a_1$, 415$a_2$, 415$a_3$, 415$a_4$, which may include, for example, bolts, mig welds, rivets or the like. A distal end 406$a_2$ of the insert tube 406*a* may be disposed within and joined to a proximal end 404$a_1$ of the bracket tube 404*a*; the fasteners 415$a_1$, 415$a_2$, 415$a_3$, 415$a_4$, may be inserted into corresponding, aligned passages of the insert tube 406*a* and bracket tube 404*a* for connecting the insert tube 406*a* to the bracket tube 404*a*. The pair of canopy bracket guide plates 408*a* may be respectively joined to opposing sides of an outer surface 416*a* of a distal end 404$a_2$ of the bracket tube 404*a* by the plurality of fasteners 410*a* and the pair of side bracket plates 412*a* by inserting the plurality of fasteners 410*a* through passages 416*a* of the pair of canopy bracket guide plates 408*a*, passages 418*a* of the pair of side bracket plates 412*a* and passages 420*a* of the opposing sides of an outer surface 416*a* of the bracket tube 404*a*.

Referring to FIG. 1A, a plurality (e.g., four) of canopy bracket subassemblies (defined by a first canopy bracket subassembly 500*a*, a second canopy bracket subassembly 500*b*, a third canopy bracket subassembly 500*c* and a fourth canopy bracket subassembly 500*d*) of the canopy subassembly 50 are shown according to an embodiment of the invention. As will be described below at FIGS. 8A-8C, once the plurality of canopy bracket subassemblies 500*a*-500*d* are joined together at least two (see, e.g., the first and fourth bracket canopy subassemblies 500*a*, 500*d*) of the plurality of canopy bracket subassemblies 500*a*-500*d* are respectively selectively pivotally connected to the pair of canopy bracket guide plates 408*a* of each canopy pivot bracket subassembly 400*a*, 400*b* by the canopy subassembly quick release locking pin 414*a*, 414*b*. Because each canopy bracket subassembly 500*a*, 500*b*, 500*c*, 500*d* of the plurality of canopy bracket subassemblies 500*a*-500*d* are substantially similar to each other and include the same components 502*a*-530*a*, 502*b*-530*b*, 502*c*-530*c* and 502*d*-530*d*, reference is only made to the first canopy bracket subassembly 500*a* below at FIGS. 6A-6B (i.e., when pairing the description of the first canopy bracket subassembly 500*a* to the second, third and fourth canopy bracket subassemblies 500*b*, 500*c*, 500*d* the reader should swap the reference letter 'a' of reference numerals 502*a*-530*a* for the reference letter 'b', 'c' or 'd', respectively).

Figure 6A:
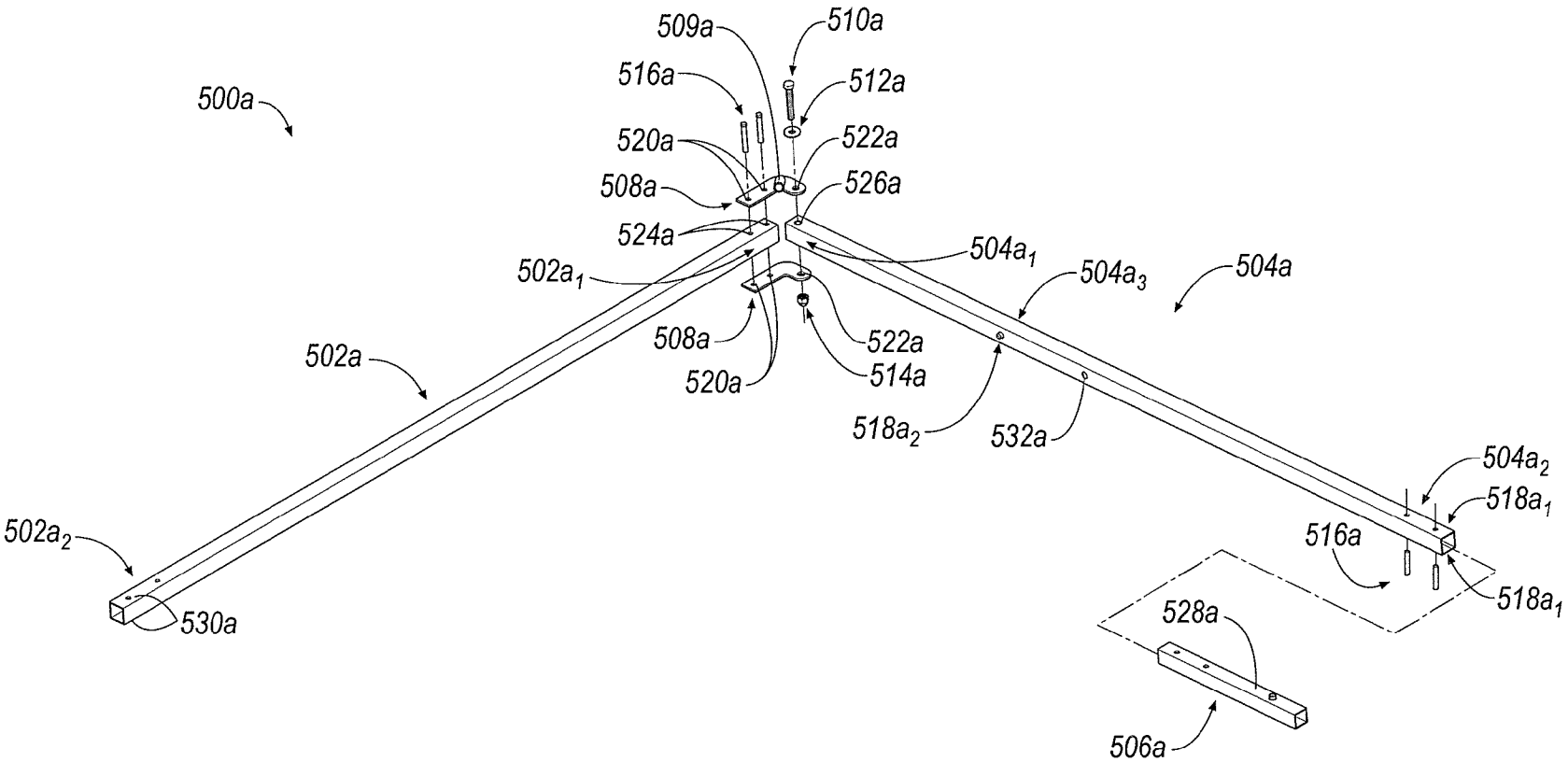
FIG. 6A is an exploded view of a portion of a canopy subassembly of the collapsible shelter of FIGS. 1A-1B.
Figure 6B:
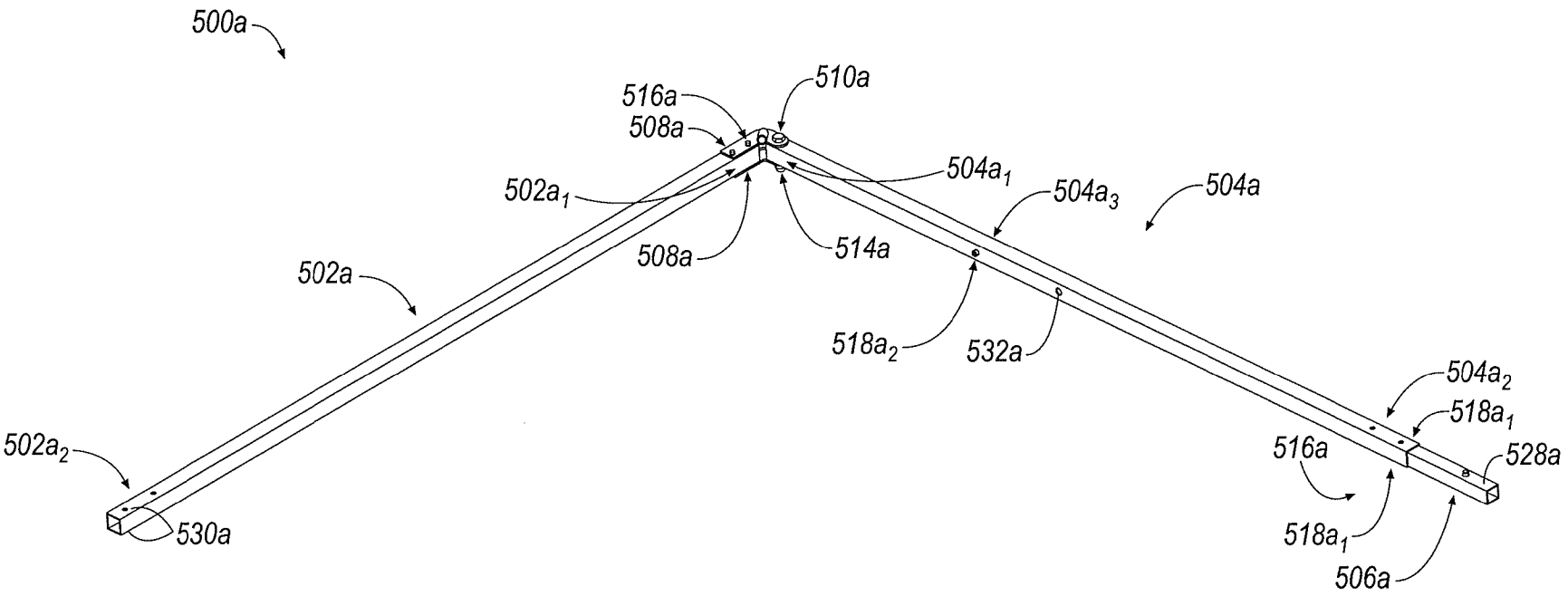
FIG. 6B is an assembled view of the portion of the canopy subassembly of FIG. 6A.

Referring to FIGS. 6A-6B, the canopy bracket subassembly 500*a* has a plurality of components 502*a*-530*a*. The plurality of components include: a first elongated tube 502*a*, a second elongated tube 504*a*, an insert tube 506*a*, a pair of (L-shaped) brackets 508*a*, a bolt 510*a*, a washer 512*a*, a nut 514*a*, pairs of fasteners 516*a* and pairs of spring-loaded ball pin locking projection 518$a_1$, 518$a_2$.

In an embodiment, each bracket 508*a* of the pair of brackets includes a pair of passages 520*a* arranged along a first length of the bracket 508*a* and one passage 522*a* arranged along a second length of the of the bracket 508*a*. The pairs of fasteners 516*a* may be inserted through the pair of passages 520*a* of the bracket 508*a* and into pairs of passages 524*a* formed by the first elongated tube 502*a* for fixing the first length of the bracket 508*a* to a first end 502$a_1$ of the first elongated tube 502*a*.

The bolt 510*a*, the washer 512*a* and the nut 514*a* may pivotally-couple a first end 504$a_1$ of the second elongated tube 504*a* to the second length of the bracket 508*a* by inserting the bolt 510*a* through the passage 522*a* and passages 526*a* formed by the second elongated tube 504*a*. By pivotally-coupling the first end 504$a_1$ of the second elongated tube 504*a* to the second length of the bracket 508*a*, the canopy bracket subassembly 500*a* may be pivotally-arranged in a deployed orientation as seen in FIG. 6B or a collapsible orientation as seen in FIGS. 7A-7F. The insert tube 506*a* may be joined to a second end 504$a_2$ of the second elongated tube 504*a* by the pair of fasteners 516*a*.

An outer surface 528*a* of the insert tube 506*a* may include the pair of spring-loaded ball pin locking projection 518$a_1$ that may be selectively-coupled to a pair of passages 530*b*, 530*c*, 530*d* formed by an adjacent, second end 502$b_2$, 502$c_2$, 502$d_2$ of one of the elongated tubes 502*b*, 502*c*, 502*d* of the second, third or fourth canopy bracket subassemblies 500*b*, 500*c*, 500*d* (noting that the pair of passages 530*a* of the second end 502$a_2$ of the elongated tube 502*a* of the corresponding first canopy bracket subassembly 500*a* is referenced in FIG. 6A). An outer surface of an intermediate portion 504$a_3$ of the second elongated tube 504*a* may include the pair of spring-loaded ball pin locking projection 518$a_2$ and a quick release locking pin passage 532*a*.

The pair of spring-loaded ball pin locking projection 518$a_2$ may be inserted into a pair of passages 422*a* (see, e.g., FIG. 5A) of the pair of canopy bracket guide plates 408*a* of the canopy pivot bracket subassembly 400*a* for selectively-coupling the intermediate portion 504$a_3$ of the second elongated tube 504*a* to the canopy pivot bracket subassembly 400*a*. The canopy subassembly quick release locking pin 414*a* may be inserted into a pair of passages 424*a* (see, e.g., FIG. 5A) of the pair of canopy bracket guide plates 408*a* of the canopy pivot bracket subassembly 400*a* for selectively pivotally coupling the intermediate portion 504$a_3$ of the second elongated tube 504*a* to the canopy pivot bracket subassembly 400*a*.

Referring to FIGS. 7A-7H, a method for utilizing the collapsible shelter 10 is shown according to an embodiment. Referring initially to FIG. 7A, the canopy support subassembly 25 of the collapsible shelter 10 may be secured to the trailer hitch, H, of the vehicle, V, as described above in a collapsed orientation. The canopy subassembly 50, the canopy cover 75 and the canopy cover support rods 600 may be stored within or upon the vehicle, V, as described above.

Figure 7F:
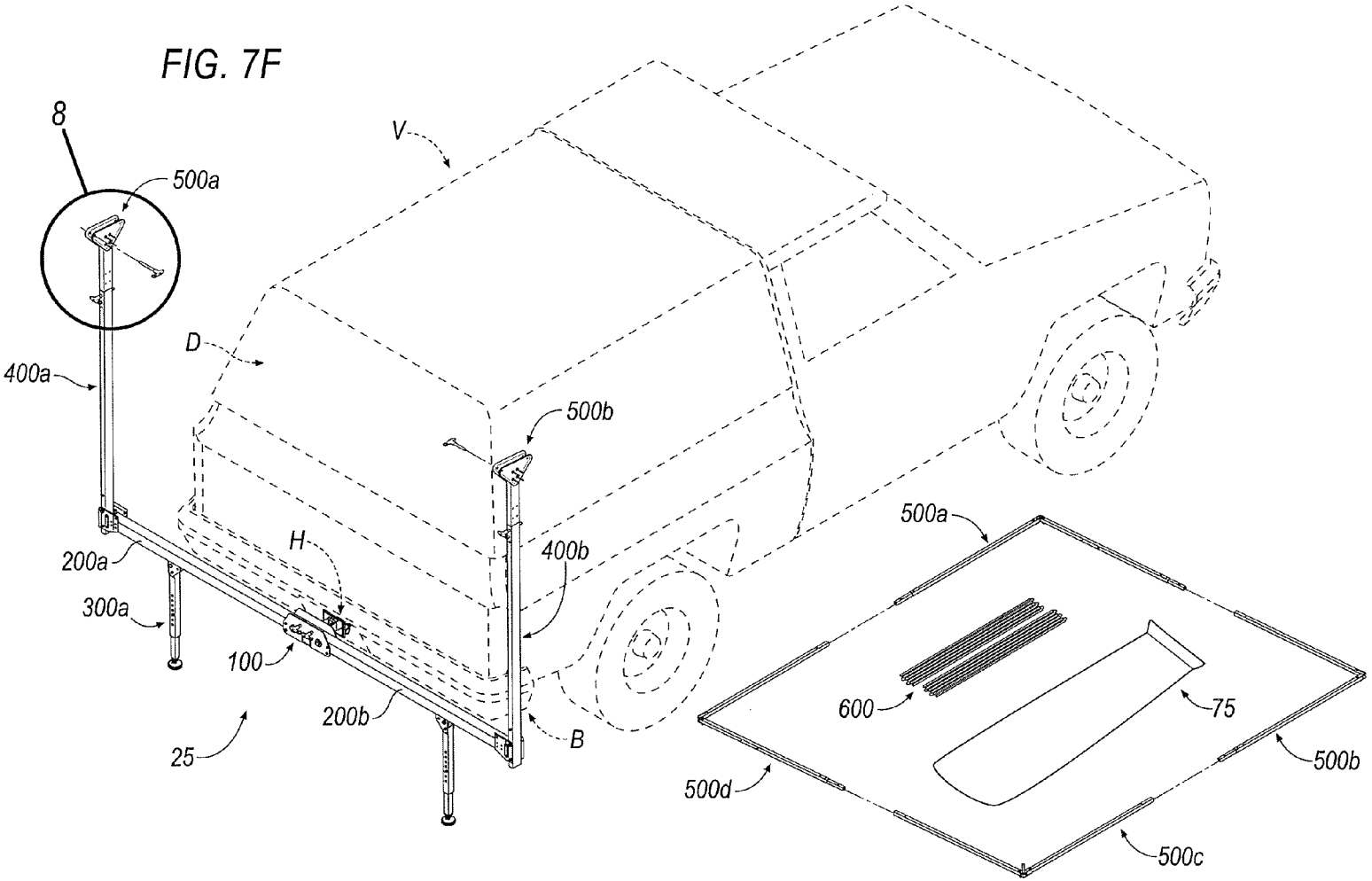
Figure 7G:
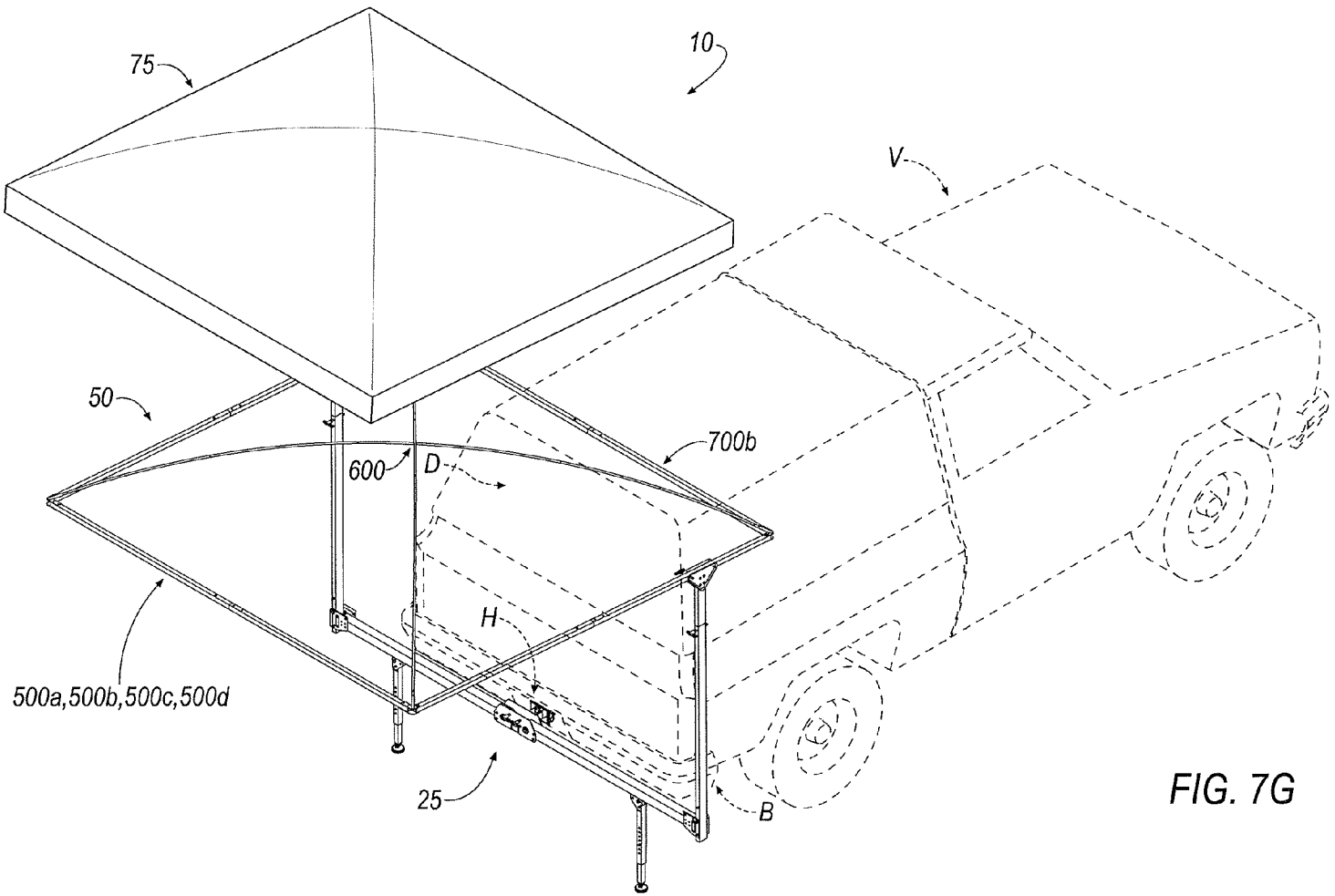
FIG. 7G is a perspective view of the vehicle of FIG. 7A and the collapsible shelter of FIGS. 1A-1B in a deployed orientation.
Figure 7H:
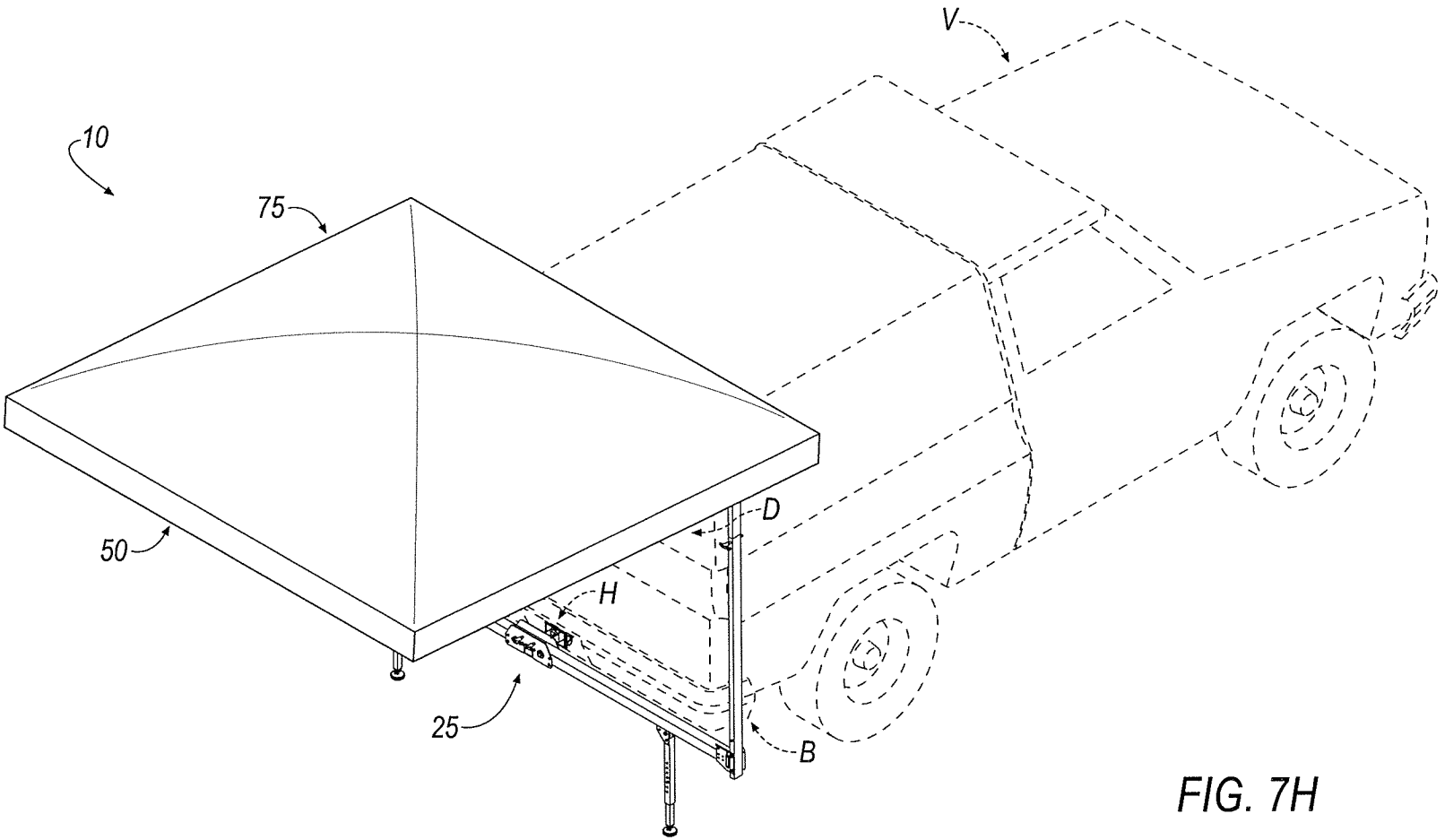
FIG. 7H is a perspective view of the vehicle of FIG. 7A and the collapsible shelter of FIGS. 1A-1B in a fully assembly orientation.

In order to manipulate the plurality of subassemblies and components 100, 200*a*, 200*b*, 300*a*, 300*b*, 400*a*, 400*b*, 500*a*, 500*b*, 600 of the collapsible shelter 10 from the stowed orientation of FIG. 7A to the deployed orientation as seen in FIGS. 1B and 7H, a user firstly manipulates the canopy support subassembly 25 from a stowed orientation in FIG. 7A to a deployed orientation as seen in FIG. 7F. Firstly, in an embodiment as seen in FIG. 7A, the first and second canopy pivot bracket subassemblies 400*a*, 400*b* are shown connected to the first and second base subassemblies 200*a*, 200*b* by fasteners (e.g., two of the quick release locking pins 118*a*, 118*b*, 402*a*, 402*b*, 414*a*, 414*b*). The fasteners (e.g., two of the quick release locking pins 118*a*, 118*b*, 402*a*, 402*b*, 414*a*, 414*b*) are removed in order to permit the first and second canopy pivot bracket subassemblies 400*a*, 400*b* to be disconnected (according to arrow, D1, of FIG. 7A) from the first and second base subassemblies 200*a*, 200*b*. As seen in FIG. 7B, the first and second canopy pivot bracket subassemblies 400*a*, 400*b* are then placed aside for subsequent re-connection to the canopy support subassembly 25 (as seen in FIGS. 7E-7F) after manipulating the subassemblies 200*a*, 200*b*, 300*a*, 300*b* of the canopy support subassembly 25.

Referring to FIG. 7B, firstly, the bumper tubes 204*a*, 204*b* of the first and second base subassemblies 200*a*, 200*b* are maintained in a stowed orientation when each projection of the pair of mounting assembly spring-loaded ball pin locking projections 202*a*, 202*b* may be respectively registered within the passages 132*a*, 132*b* of the brackets 104*a*, 104*b* of the mounting subassembly 100. Then, the spring-loaded ball pin locking projections 202*a*, 202*b* may be depressed for de-registering the spring-loaded ball pin locking projections 202*a*, 202*b* from within the passages 132*a*, 132*b* of the brackets 104*a*, 104*b* for pivotally-unlocking the bumper tubes 204*a*, 204*b* relative the mounting subassembly 100. Then, as seen in FIG. 7B, the bumper tubes 204*a*, 204*b* are pivotally-deployed relative the mounting subassembly 100 by pivotally-rotating the bumper tubes 204*a*, 204*b* relative the mounting subassembly 100 according to the direction of the arrow, D2.

Referring to FIG. 7C, the first and second leg subassemblies 300*a*, 300*b* are then pivotally-rotated according to the direction of the arrow, D3, relative the first and second base subassemblies 200*a*, 200*b*. The first and second leg subassemblies 300*a*, 300*b* may cease the pivotable movement, D3, when the first and second leg subassemblies 300*a*, 300*b* are arranged substantially perpendicularly with respect to the first and second base subassemblies 200*a*, 200*b*. The inner leg 306*a*, 306*b* of the first and second leg subassemblies 300*a*, 300*b* may then be telescopingly-deployed relative the outer leg 304*a*, 304*b* of the first and second leg subassemblies 300*a*, 300*b* such that the adjustable foot 310*a*, 310*b* directly contacts an underlying ground surface.

Referring to FIG. 7D, the canopy-supporting tubes 206*a*, 206*b* are pivotally-locked relative the bumper tubes 204*a*, 204*b* in stowed orientation as a result of the pair of stowed position spring-loaded ball pin locking projections 220*a*, 220*b* being registered within the passages 260*a*$_1$, 260*a*$_2$, 260*b*$_1$, 260*b*$_2$ of the first and second brackets 208*a*, 208*b*. Then, the stowed position spring-loaded ball pin locking projections 220*a*, 220*b* may be depressed for de-registering the stowed position spring-loaded ball pin locking projections 220*a*, 220*b* from within the 260*a*$_1$, 260*a*$_2$, 260*b*$_1$, 260*b*$_2$ of the first and second brackets 208*a*, 208*b* for pivotally-unlocking the canopy-supporting tubes 206*a*, 206*b* relative the bumper tubes 204*a*, 204*b*. Then, as seen in FIG. 7D, the canopy-supporting tubes 206*a*, 206*b* are pivotally-deployed relative the bumper tubes 204*a*, 204*b* by pivotally-rotating the canopy-supporting tubes 206*a*, 206*b* relative the bumper tubes 204*a*, 204*b* according to the direction of the arrow, D4. The canopy-supporting tubes 206*a*, 206*b* may cease deployment according to the direction of the arrow, D4, once the canopy-supporting tubes 206*a*, 206*b* are arranged substantially perpendicularly relative the bumper tubes 204*a*, 204*b* (as seen in FIG. 7E) such that the pair of deployed position spring-loaded ball pin locking projections 222*a* are registered within the passages 262*a*$_1$, 262*a*$_2$, 262*b*$_1$, 262*b*$_2$ of the first and second brackets 208*a*, 208*b* for selectively-locking the canopy-supporting tube 206*a* relative the bumper tube 204*a* in the deployed orientation (as seen in FIG. 7E).

Referring to FIG. 7E, a proximal end 406*a*$_1$ of the insert tubes 406*a*, 406*b* of the first and second canopy pivot bracket subassemblies 400*a*, 400*b* are respectively inserted into the distal end 206*a*$_2$, 206*b*$_2$ of the canopy-supporting tube 206*a*, 206*b* according to the direction of arrows, D5. Referring to FIG. 7F, the insert tubes 406*a*, 406*b* of the first and second canopy pivot bracket subassemblies 400*a*, 400*b* are respectively selectively locked to the distal end 206*a*$_2$, 206*b*$_2$ of the canopy-supporting tube 206*a*, 206*b* by the canopy support subassembly quick release locking pin 402*a*, 402*b*.

Figures 8A, 8B, 8C:
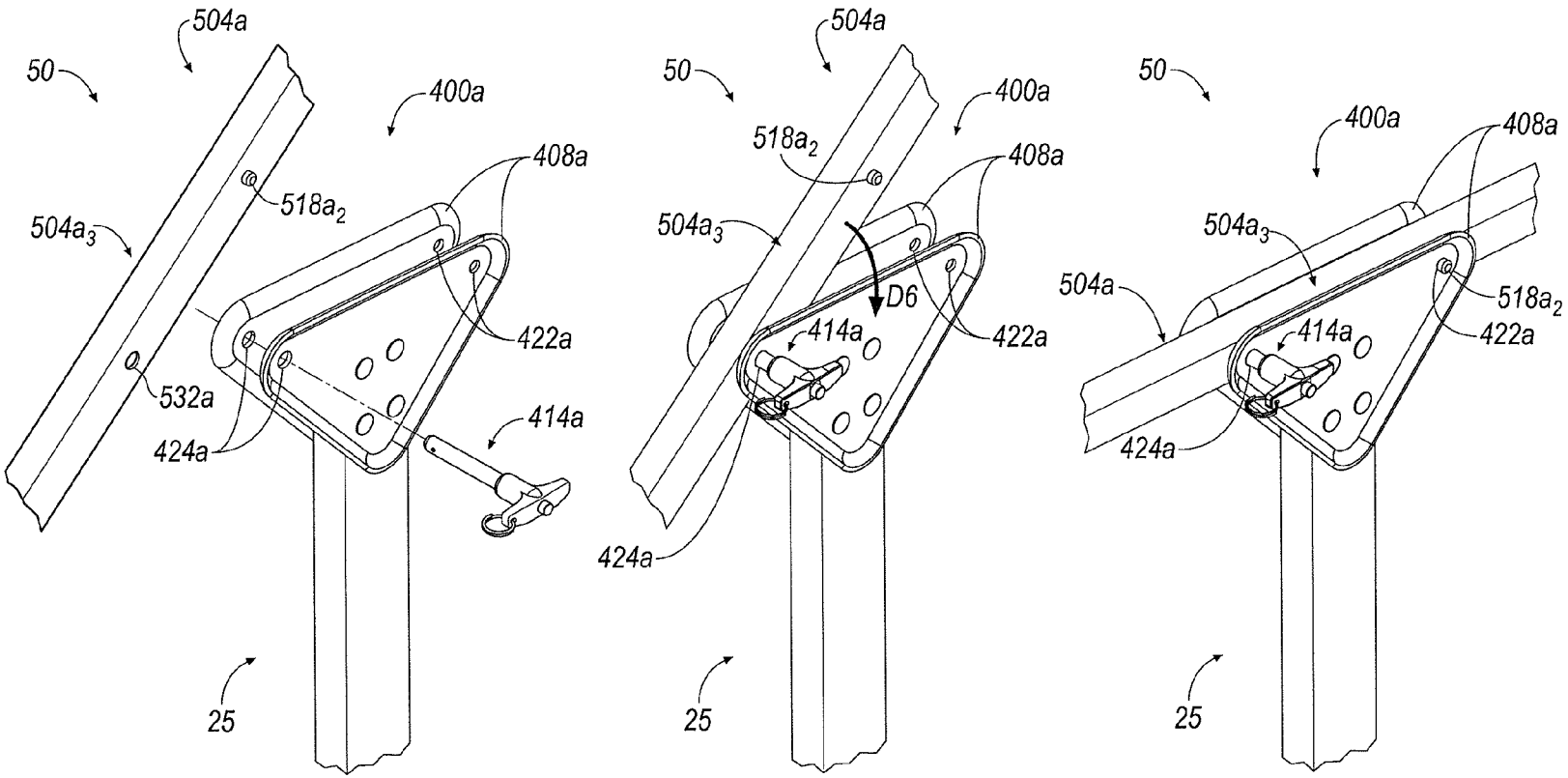
FIGS. 8A-8C are enlarged views of a portion of the collapsible shelter according to line 8 of FIG. 7F illustrating views of the collapsible shelter being assembled in several steps taking place between FIGS. 7F-7G.

Once the the first and second canopy pivot bracket subassemblies 400*a*, 400*b* are selectively-locked to the distal end 206*a*$_2$, 206*b*$_2$ of the canopy-supporting tube 206*a*, 206*b*, the canopy subassembly 50 may be joined to the canopy support subassembly 25 as seen in FIGS. 8A-8C. However, prior to joining the canopy subassembly 50 may be joined to the canopy support subassembly 25, the first, second, third and fourth canopy bracket subassemblies 500*a*, 500*b*, 500*c*, 500*d* are pivotally-deployed from a collapsed orientation as seen in FIGS. 7A-7F to an expanded, substantially perpendicular orientation as seen in FIG. 6B. Then, the pairs of spring-loaded ball pin locking projections 518*a*$_1$, 518*b*$_1$, 518*c*$_1$, 518*d*$_1$ are respectively selectively-coupled adjacent to the pairs of passages 530*a*, 530*b*, 530*c*, 530*d* of adjacent first, second, third and fourth canopy bracket subassemblies 500*a*, 500*b*, 500*c*, 500*d* for assembling a canopy material support frame (as seen in FIG. 7G). Then, the canopy cover support rods 600 may be connected to the canopy material support frame 500*a*, 500*b*, 500*c*, 500*d* (by, for example, inserting an end of each support rod 600 in a rod-receiving recess 509*a* (see, e.g., FIG. 6A) formed by each bracket 508*a*, 508*b*, 508*c*, 508*d* of each canopy bracket subassembly 500*a*, 500*b*, 500*c*, 500*d*) in the shape of an X (as seen in FIG. 7G) for fully assembling the canopy subassembly 50.

Once the canopy subassembly 50 is assembled as described above, the canopy subassembly 50 may be arranged relative the first and second canopy pivot bracket subassemblies 400*a*, 400*b* as seen in FIG. 8A in a non-parallel orientation with respect to an underlying ground surface. The canopy subassembly quick release locking pins 414*a*, 414*b* may then be inserted into pairs of passages 424*a*, 424*b* of the pair of canopy bracket guide plates 408*a*, 408*b* of the canopy pivot bracket subassemblies 400*a*, 400*b* and quick release locking pin passages 532*a*, 532*b* of the second elongated tubes 504*a*, 504*b* for selectively pivotally coupling the intermediate portion 504*a*$_3$, 504*b*$_3$ of the second elongated tubes 504*a*, 504*b* of the canopy material support frame 500*a*, 500*b*, 500*c*, 500*d* to the canopy pivot bracket subassemblies 400*a*, 400*b*.

Referring to FIG. 8B, once the canopy material support frame 500*a*, 500*b*, 500*c*, 500*d* is pivotally-coupled to the canopy pivot bracket subassemblies 400*a*, 400*b*, the canopy material support frame 500*a*, 500*b*, 500*c*, 500*d* may be pivoted according to the direction of the arrow, D6, about the canopy subassembly quick release locking pins 414*a*, 414*b* for arranging the canopy subassembly 50 in a parallel orientation with respect to an underlying ground surface (as seen in FIG. 8C). Once the canopy subassembly 50 is arranged in a parallel orientation with respect to an underlying ground surface, the pair of spring-loaded ball pin locking projection 518$a_2$, 518$b_2$ may be inserted into the pairs of passages 422*a*, 422*b* of the pairs of canopy bracket guide plates 408*a*, 408*b* of the canopy pivot bracket subassemblies 400*a*, 400*b* for selectively-locking the intermediate portion 504$a_3$, 504$b_3$ of the second elongated tubes 504*a*, 504*b* to the canopy pivot bracket subassemblies 400*a*, 400*b*.

Referring to FIGS. 7G-7H, the canopy cover 75 may be arranged over and adjacent the canopy material support frame 500*a*, 500*b*, 500*c*, 500*d* and the canopy cover support rods 600 for completing the assembly of the collapsible shelter 10. The canopy cover 75 may inhibit or prevent the elements (e.g., sunlight, rain, snow or the like) from coming into contact with persons or items arranged under the collapsible shelter 10.

The present invention has been described with reference to certain exemplary embodiments thereof. However, it will be readily apparent to those skilled in the art that it is possible to embody the invention in specific forms other than those of the exemplary embodiments described above. This may be done without departing from the spirit of the invention. The exemplary embodiments are merely illustrative and should not be considered restrictive in any way. The scope of the invention is defined by the appended claims and their equivalents, rather than by the preceding description.

What is claimed is:

1. A collapsible shelter, comprising:

a canopy support subassembly;

a canopy subassembly removably and pivotally connected to the canopy support subassembly; and a canopy cover removably-disposed over the canopy subassembly, wherein the canopy support subassembly includes a mounting subassembly, a first base subassembly pivotally-connected to a first end of the mounting subassembly, a second base subassembly pivotally-connected to a second end of the mounting subassembly, a first leg subassembly pivotally-connected to the first base subassembly, a second leg subassembly pivotally-connected to the second base subassembly, a first canopy pivot bracket subassembly removably connected to the first base subassembly, and a second canopy pivot bracket subassembly removably-connected to the second base subassembly, wherein each of the first base and second base subassemblies include a bumper tube and a canopy-supporting tube, wherein the bumper tube of each of the first and second base subassemblies includes a proximal end, a distal end opposing the proximal end, and a pair of locking projections near the proximal end of the bumper tube of each of the first and second base subassemblies, and wherein the pair of locking projections engage passages at the mounting subassembly for pivotally locking and unlocking the bumper tube of each of the first and second base subassemblies to allow movement between a stowed orientation and a deployed orientation.

2. The collapsible shelter according to claim 1, wherein the first canopy pivot bracket subassembly is removably-joined to a distal end of the canopy-supporting tube of the first base subassembly, wherein the second canopy pivot bracket subassembly is removably-joined to a distal end of the canopy-supporting tube of the second base subassembly.

3. The collapsible shelter according to claim 1, wherein the first leg subassembly is pivotally-connected to the bumper tube of the first base subassembly, wherein the second leg subassembly is pivotally-connected to the bumper tube of the second base subassembly.

4. The collapsible shelter according to claim 1, wherein the canopy subassembly includes a plurality of removably-connected canopy bracket subassemblies that form a canopy material support frame, wherein a first side of the canopy material support frame is removably and pivotally connected to the first canopy pivot bracket subassembly, wherein a second side of the canopy material support frame is removably and pivotally connected to the second canopy pivot bracket subassembly.

5. The collapsible shelter according to claim 4, wherein the canopy subassembly includes a plurality of canopy cover support rods that are removably-connected to the canopy material support frame.

6. The collapsible shelter according to claim 5, wherein the canopy cover removably-arranges over and connects to the canopy material support frame and the canopy cover support rods.

7. The collapsible shelter according to claim 1, wherein the mounting subassembly is operable for mounting the collapsible shelter to a mounting structure.

8. The collapsible shelter according to claim 7, wherein the mounting structure is a hitch of a vehicle for permitting the collapsible shelter to be removably-mounted to the vehicle, wherein the canopy support subassembly is removably-connected to the hitch of the vehicle in one of the stowed orientation and the deployed orientation.

9. The collapsible shelter according to claim 8, wherein the canopy support subassembly is capable of connecting to the hitch of the vehicle in both the stowed orientation and the deployed orientation.

10. The collapsible shelter according to claim 8, wherein an arrangement of the canopy support subassembly in the deployed orientation results in the bumper tube of each of the first and second base subassemblies being arranged in parallel to and next to but slightly spaced apart from a bumper of the vehicle while the canopy-supporting tube of each of the first and second base subassemblies is arranged substantially perpendicular with respect to the bumper tube.

11. The collapsible shelter according to claim 10, wherein the bumper tube of each of the first and second base subassemblies extend linearly in opposite directions from the mounting subassembly when the canopy support subassembly is arranged in the deployed orientation.

12. The collapsible shelter according to claim 11, wherein the opposite directions are along a single line.

13. The collapsible shelter according to claim 10, wherein the arrangement of the canopy support subassembly in the deployed orientation results in:

the canopy-supporting tube of the first base subassembly extending vertically from the distal end of the bumper tube of the first base subassembly; and the canopy-supporting tube of the second base subassembly extending vertically from the distal end of the bumper tube of the second base subassembly.

14. The collapsible shelter according to claim 10, wherein the canopy subassembly is removably and pivotally connected to the canopy support subassembly in a cantilevered manner relative the canopy support subassembly such that a distal end of the canopy subassembly is not supported by any structural member, thereby defining an interference-free area directly underneath three of four sides of the canopy subassembly that defines a footprint of the canopy subassembly.

15. The collapsible shelter according to claim 1, wherein the canopy support subassembly removably-mounts to a mounting structure in a compacted position when the collapsible shelter arranges in the stowed orientation.

16. The collapsible shelter according to claim 15, wherein the mounting structure associates with a vehicle, and wherein the vehicle is operable while the canopy support subassembly, in the compacted position, is removably-mounted to the mounting structure.

17. The collapsible shelter according to claim 1, wherein the canopy support subassembly includes no more than two legs.

18. The collapsible shelter according to claim 1, wherein a proximal end of the canopy-supporting tube of the first base subassembly pivotally-connects to the distal end of the bumper tube of the first base subassembly, and wherein a proximal end of the canopy-supporting tube of the second base subassembly pivotally-connects to the distal end of the bumper tube of the second base subassembly.

19. A collapsible shelter, comprising:

a canopy support subassembly;

a canopy subassembly removably and pivotally connected to the canopy support subassembly; and a canopy cover removably-disposed over the canopy subassembly, wherein the canopy support subassembly includes a mounting subassembly, a first base subassembly pivotally-connected to a first end of the mounting subassembly, a second base subassembly pivotally-connected to a second end of the mounting subassembly, a first leg subassembly pivotally-connected to the first base subassembly, a second leg subassembly pivotally-connected to the second base subassembly, a first canopy pivot bracket subassembly removably connected to the first base subassembly, and a second canopy pivot bracket subassembly removably-connected to the second base subassembly, wherein the canopy subassembly includes a plurality of removably-connected canopy bracket subassemblies that form a canopy material support frame, wherein a first side of the canopy material support frame is removably and pivotally connected to the first canopy pivot bracket subassembly, wherein a second side of the canopy material support frame is removably and pivotally connected to the second canopy pivot bracket subassembly, wherein the canopy subassembly includes a plurality of canopy cover support rods that are removably-connected to the canopy material support frame, and wherein each of the plurality of canopy cover support rods removably connect to the canopy material support frame at a rod receiving recess.

20. The collapsible shelter according to claim 19, wherein each of the first and second base subassemblies include:

a bumper tube, and a canopy-supporting tube.

21. The collapsible shelter according to claim 20, wherein the canopy-supporting tube of each of the first and second base subassemblies includes a proximal end, a distal end opposing the proximal end, and a pair of locking projections near the proximal end of the canopy-supporting tube of each of the first and second base subassemblies, and wherein the pair of locking projections allow the canopy-supporting tube of each of the first and second base subassemblies to pivotally lock and unlock, permitting movement of the canopy-supporting tube of each of the first and second base subassemblies between a stowed orientation position and a deployed orientation position.

22. The collapsible shelter according to claim 20, wherein a proximal end of the bumper tube of each of the first and second base subassemblies is pivotally-connected to the mounting subassembly, wherein a proximal end of the canopy-supporting tube is pivotally-connected to a distal end of the bumper tube.

23. The collapsible shelter according to claim 19, wherein the collapsible shelter mounts to a location for mounting.

24. The collapsible shelter according to claim 23, wherein the location for mounting is a trailer hitch proximate a rear bumper of a vehicle.

25. The collapsible shelter according to claim 24, wherein the canopy support subassembly contracts to a compacted position when the collapsible shelter arranges from a deployed orientation to a stowed orientation, and wherein components of the canopy support subassembly removably or pivotally connect when arranged in the compacted position.

26. The collapsible shelter according to claim 25, wherein, when arranged in the deployed orientation and mounted to the trailer hitch, the collapsible shelter does not interfere with operation of or deny access to a rear end of the vehicle.

27. A method, comprising:

providing a collapsible shelter including a canopy support subassembly, a canopy subassembly, and a canopy cover;

arranging the canopy support subassembly in a deployed orientation from a stowed orientation;

removably-and-pivotally-connecting the canopy subassembly to the canopy support subassembly; and removably-disposing the canopy cover over the canopy subassembly, wherein the arranging step includes:

pivoting a proximal end of a bumper tube of each of a first and second base subassembly of the canopy support subassembly relative a mounting subassembly, then pivoting a proximal end of a canopy-supporting tube of the first and second base subassemblies of the canopy support subassembly relative a distal end of the bumper tube, wherein the mounting subassembly is removably mounted to a vehicle when the canopy supporting subassembly is arranged in both the deployed orientation and the stowed orientation, and wherein the bumper tube of each of the first and second base subassemblies pivots to a position substantially parallel with a bumper of the vehicle when the canopy support subassembly is arranged in the deployed orientation.

28. The method according to claim 27, wherein the arranging step further includes:

removably-joining first and second canopy pivot bracket subassemblies of the canopy support subassembly to a distal end of the canopy-supporting tube of the first and second base subassemblies of the canopy support subassembly.

29. The method according to claim 27, wherein the arranging step further includes:

pivoting first and second leg subassemblies of each of the first and second base subassemblies of the canopy support subassembly relative to the bumper tube of each of the first and second base subassemblies of the canopy support subassembly.

30. The method according to claim 27, wherein the canopy subassembly includes a plurality of canopy bracket subassemblies, wherein after the arranging step and before the removably-and-pivotally-connecting step, further comprising the step of forming a canopy material support frame by removably-connecting a plurality of canopy bracket subassemblies, wherein the removably-and-pivotally-connecting step includes:

pivotally-connecting respective first and second sides of the canopy material support frame to first and second canopy pivot bracket subassemblies of the canopy support subassembly.

31. The method according to claim 30, wherein the canopy subassembly includes a plurality of canopy cover support rods, wherein after the removably-and-pivotally-connecting step and before the removably-disposing step, further comprising the step of:

removably-connecting a plurality of canopy cover support rods to the canopy material support frame.

* * * * *

UNITED STATES PATENT AND TRADEMARK OFFICE

CERTIFICATE OF CORRECTION

PATENT NO. : 9,163,426 B1
APPLICATION NO. : 14/020236
DATED : October 20, 2015
INVENTOR(S) : Stephen A. Seneker et al.

It is certified that error appears in the above-identified patent and that said Letters Patent is hereby corrected as shown below:

Title Page, Item 73 Assignee: Please delete "Tilden KKC, Bloomfield Hills, MI (US)" and insert --Tilden LLC, Bloomfield Hills, MI (US)--

Signed and Sealed this
Ninth Day of August, 2016

Michelle K. Lee

Michelle K. Lee
*Director of the United States Patent and Trademark Office*